US012663202B2

(12) United States Patent
Kang et al.

(10) Patent No.: US 12,663,202 B2
(45) Date of Patent: Jun. 23, 2026

(54) REFRIGERATOR

(71) Applicant: LG Electronics Inc., Seoul (KR)

(72) Inventors: Daekil Kang, Seoul (KR); Jinho Chang, Seoul (KR); Jaehoon Shin, Seoul (KR); Wookyung Baik, Seoul (KR); Changho Seo, Seoul (KR); Heejun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 226 days.

(21) Appl. No.: 18/542,027

(22) Filed: Dec. 15, 2023

(65) Prior Publication Data

US 2024/0200855 A1 Jun. 20, 2024

(30) Foreign Application Priority Data

Dec. 16, 2022 (KR) ..... 10-2022-0177597
Dec. 6, 2023 (KR) ..... 10-2023-0175979

(51) Int. Cl.
*F25D 23/02* (2006.01)

(52) U.S. Cl.
CPC ..... *F25D 23/028* (2013.01); *F25D 23/025* (2013.01); *F25D 2323/021* (2013.01)

(58) Field of Classification Search
CPC ..... F25D 23/025; F25D 23/028; F25D 23/02; F25D 23/04
See application file for complete search history.

(56) References Cited

U.S. PATENT DOCUMENTS 8,745,992 B2 6/2014 Cheong et al.
8,801,124 B2 * 8/2014 Jung ..... F25D 23/028 312/405
10,598,422 B2 3/2020 Park et al.
11,359,414 B2 * 6/2022 Ayyawar ..... E05C 7/02
2011/0023528 A1 2/2011 Kwon et al.
(Continued)

FOREIGN PATENT DOCUMENTS

KR 10-2009-0059660 A 6/2009
KR 10-2010-0116742 11/2010
(Continued)

OTHER PUBLICATIONS

Extended European Search Report in European Appln. No. 23216786.6, mailed on May 7, 2024, 7 pages.
(Continued)

*Primary Examiner* — Lionel Nouketcha
(74) *Attorney, Agent, or Firm* — Fish & Richardson P.C.

(57) ABSTRACT

A refrigerator includes a cabinet in which a refrigerating compartment and a freezing compartment, each of which has an opened front surface, are defined, and a door configured to open and close the refrigerating compartment. The refrigerating compartment door includes a first door rotatably mounted on the cabinet, and a second door provided in front of the first door and configured to rotate in the same direction as the first door so as to open and close at least a portion of a front surface of the first door. The first door includes an ice-making chamber which is defined in the first door and in which an ice maker is accommodated, and a door storage portion provided in front of the ice-making chamber and opened and closed by the second door to store food.

17 Claims, 18 Drawing Sheets

(56) References Cited

U.S. PATENT DOCUMENTS

| | | | | |
|---|---|---|---|---|
| 2011/0146326 | A1* | 6/2011 | Choi | F25D 23/04 62/344 |
| 2012/0096872 | A1* | 4/2012 | Cheong | F25D 23/025 62/340 |
| 2015/0260447 | A1 | 9/2015 | Kim et al. | |
| 2016/0138855 | A1* | 5/2016 | Choo | E05B 47/06 312/405.1 |
| 2018/0202705 | A1 | 7/2018 | Eicher et al. | |
| 2018/0328641 | A1 | 11/2018 | Lee et al. | |
| 2019/0093938 | A1 | 3/2019 | Miller et al. | |
| 2021/0148623 | A1* | 5/2021 | Jeong | F25C 1/24 |
| 2024/0044567 | A1* | 2/2024 | Lee | F25D 17/065 |
| 2024/0077243 | A1 | 3/2024 | Lee et al. | |

FOREIGN PATENT DOCUMENTS

| | | |
|---|---|---|
| KR | 10-2012-0040891 | 4/2012 |
| KR | 3190364 | 7/2017 |
| KR | 10-2017-0111173 | 10/2017 |
| KR | 10-2018-0065446 | 6/2018 |
| KR | 10-2019-0137477 | 12/2019 |
| KR | 10-2189357 | 12/2020 |
| KR | 10-2022-0122176 | 9/2022 |
| KR | 10-2024-0062605 A | 5/2024 |
| WO | 2022/057615 A1 | 3/2022 |
| WO | WO 2024/028770 | 2/2024 |

OTHER PUBLICATIONS

Extended European Search Report in European Appln. No. 23216811.2, mailed on May 7, 2024, 6 pages.

International Search Report in International Appln. No. PCT/KR2023/020799, mailed on Mar. 19, 2024, 3 pages.

Office Action in U.S. Appl. No. 18/542,046, mailed on Jul. 7, 2025, 23 pages.

Extended European Search Report in European Appln. No. 23904073.6, mailed on Jan. 30, 2026, 8 pages.

Notice of Allowance in European Appln. No. 23216786.6, mailed on Dec. 16, 2025, 8 pages.

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2022-0177597, filed on Dec. 16, 2022, and Korean Patent Application No. 10-2023-0175979, filed on Dec. 6, 2023, which are hereby incorporated by reference in their entirety.

BACKGROUND

The present disclosure relates to a refrigerator.

In general, a refrigerator is a home appliance for storing foods in an internal storage space, which is shield by a door, at a low temperature by low temperature air. For this, the refrigerator cools the inside of the storage space using cool air generated by heat-exchanging with a refrigerant that circulates a cooling cycle to store the foods in an optimum state.

In recent years, refrigerators have become increasingly multi-functional with changes of dietary lives and gentrification of products, and refrigerators having various structures and convenience devices for convenience of users and for efficient use of internal spaces have been released.

Representatively, a refrigerator may be provided with an ice maker that automatically makes and stores ice. In addition, a refrigerator provided with a dispenser that allows the ice made in the ice maker to be taken out to the outside is being developed.

SUMMARY

Embodiments provide a refrigerator in which a storage space that is opened and closed by a second door and an ice-making chamber are efficiently disposed in a first door.

Embodiments also provide a refrigerator in which a storage space that is visible through a second door, a dispenser, and an ice maker are efficiently disposed in a first door.

Embodiments also provide a refrigerator in which an ice-making chamber and a door storage portion are independently provided in a freezing compartment door, and cold air is efficiently supplied to the ice-making chamber and the door storage portion.

In one embodiment, a refrigerator includes: a cabinet in which a refrigerating compartment and a freezing compartment, each of which has an opened front surface, are defined; and a door configured to open and close the refrigerating compartment, wherein the refrigerating compartment door includes: a first door rotatably mounted on the cabinet; and a second door provided in front of the first door and configured to rotate in the same direction as the first door so as to open and close at least a portion of a front surface of the first door, wherein the first door includes: an ice-making chamber which is defined in the first door and in which an ice maker is accommodated; and a door storage portion provided in front of the ice-making chamber and opened and closed by the second door to store food.

The ice-making chamber may be recessed from a rear surface of the first door, the door storage portion may be recessed from a front surface of the first door, and an opened rear surface of the ice-making chamber may be opened and closed by an ice-making chamber door.

A rear surface of the second door may be recessed to define at least a portion of the door storage portion.

The door storage portion may be disposed between the first door and the second door in a state in which the second door is closed.

A dispenser configured to communicate with the ice-making chamber so as to dispense ice may be provided in a front surface of the first door, and the dispenser may be provided below the door storage portion.

The second door may be configured to shield the door storage portion and the dispenser at the same time.

The second door may be provided with a panel assembly that overlaps at least a partial area of the door storage portion and the dispenser and is transparent so that a rear side of the second door is visible.

A display may be provided between the door storage portion and the dispenser, and the display may be visualized through the panel assembly.

A door light that is turned on and off by user's manipulation to selectively brighten the inside of the door storage portion may be provided on the first door or the second door.

The refrigerator may further include a cold air duct configured to pass through the first door, wherein the cold air duct may be provided with a passage through which the cold air of the refrigerating compartment flows to the door storage portion by bypassing the ice-making chamber.

The first door may be provided with a storage portion fan configured to force a flow of the cold air passing through the cold air duct.

The cold air duct may include: a supply duct configured to pass through the first door so as to supply the cold air of the refrigerating compartment to the door storage portion; and a discharge duct provided below the supply duct and configured to pass through the first door so as to discharge the cold air of the door storage portion to the refrigerating compartment.

The first door may further include: a supply duct configured to allow the refrigerating compartment to communicate with the door storage portion; and a through-portion configured to pass through a lower portion of the first door so as to pass below the dispenser, wherein the cold air of the refrigerating compartment may be introduced into the door storage portion through the supply duct, and the cold air of the door storage portion may be discharged to the refrigerating compartment through the through-portion.

An ice outlet configured to discharge ice of the ice-making chamber and a manipulation member configured to manipulate dispensing of the ice through the ice outlet may be provided on a top surface of the through-portion.

A second door storage portion configured to store food may be further provided in the through-portion.

The through-portion may be shielded by the second door, and the second door may be provided with a panel assembly that is transparent so that the door storage portion and the second door storage portion are visible.

The first door may include: a supply duct configured to pass through the first door from an upper side of the ice-making chamber and allow an upper portion of the door storage portion to communicate with the refrigerating compartment so that the cold air is supplied to the door storage portion; and a discharge duct configured to pass through the first door from a lower side of the ice-making chamber and allow a lower portion of the door storage portion to communicate with the refrigerating compartment so that the cold air is discharged to the refrigerating compartment.

The discharge duct may extend to pass between a lower side of the ice-making chamber and an upper side of the dispenser.

The discharge duct may extend to pass through the dispenser.

The dispenser may be provided below the door storage portion, and the second door may be configured to open and close the door storage portion above the dispenser.

A protrusion further protruding forward than the door storage portion may be disposed at a lower portion of the first door, and the dispenser may be provided in the protrusion.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

In the description of the elements of the present invention, the terms first, second, A, B, (a), and (b) may be used. These terms are only used to distinguish the component from other components, and the essence, sequence, or the order of corresponding component is not limited by the term. It should be understood that when an element is described as being "connected," "coupled", or "joined" to another element, the former may be directly connected or jointed to the latter or may be "connected", coupled" or "joined" to the latter with a third component interposed therebetween.

Prior to a description, directions are defined. In an embodiment of the present disclosure, a direction facing a front surface of the door illustrated in FIG. 2 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction.

Figure 1:
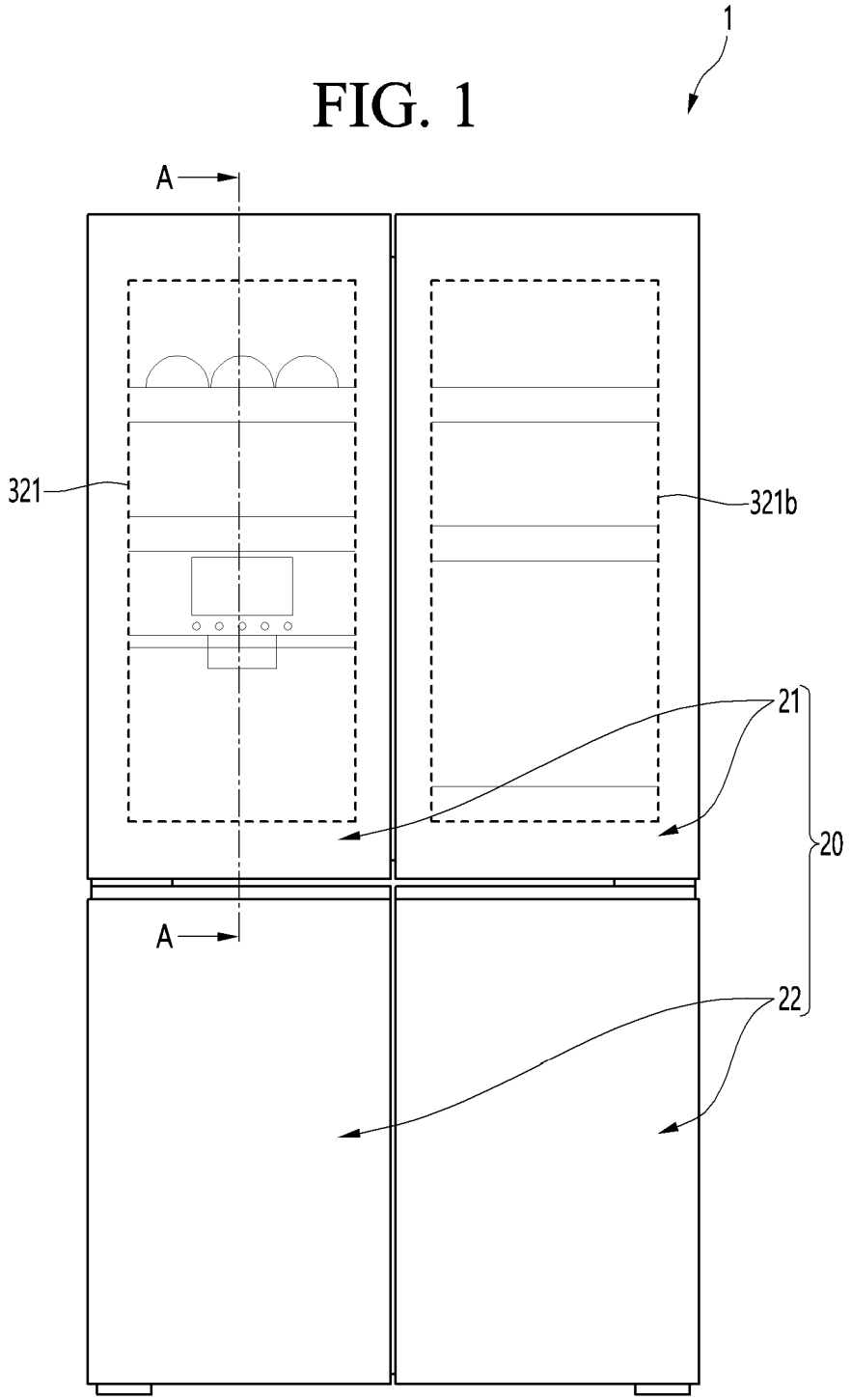
FIG. 1 is a front view of a refrigerator according to a first embodiment.
Figure 2:
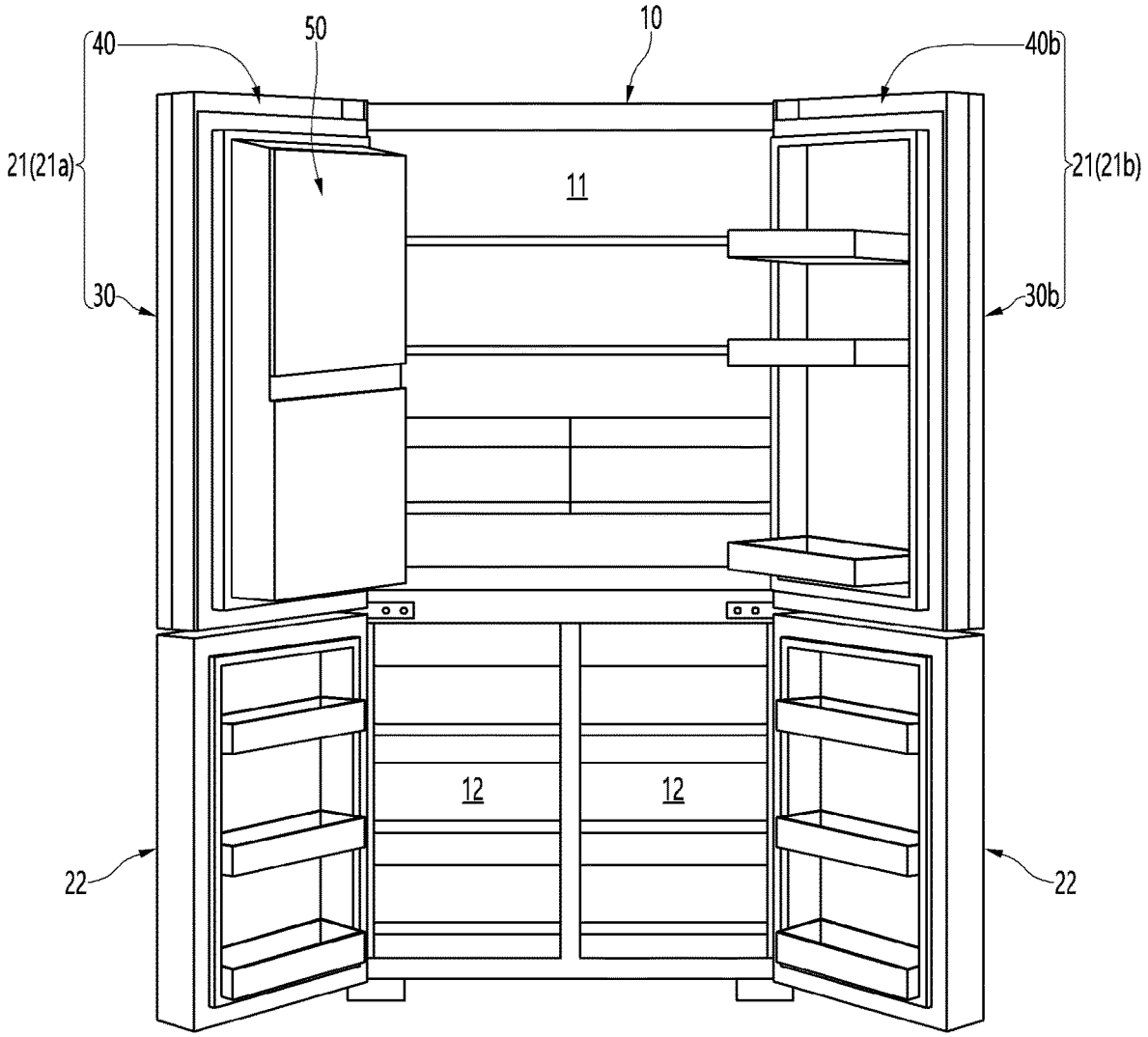
FIG. 2 is a front view illustrating a state in which a door of the refrigerator is opened.
Figure 3:
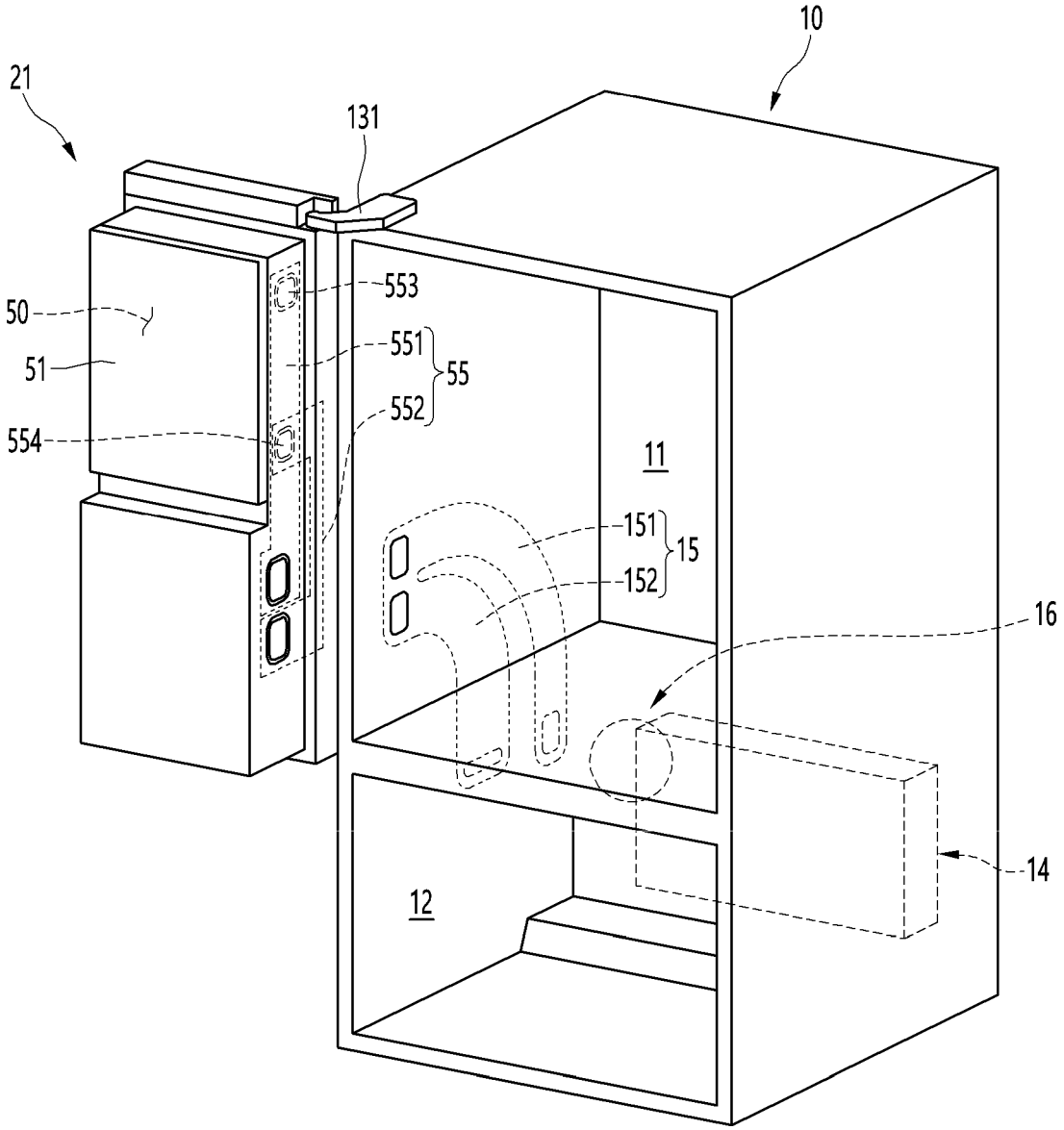
FIG. 3 is a view illustrating a cold air flow state between a cabinet and an ice-making chamber.
Figure 4:
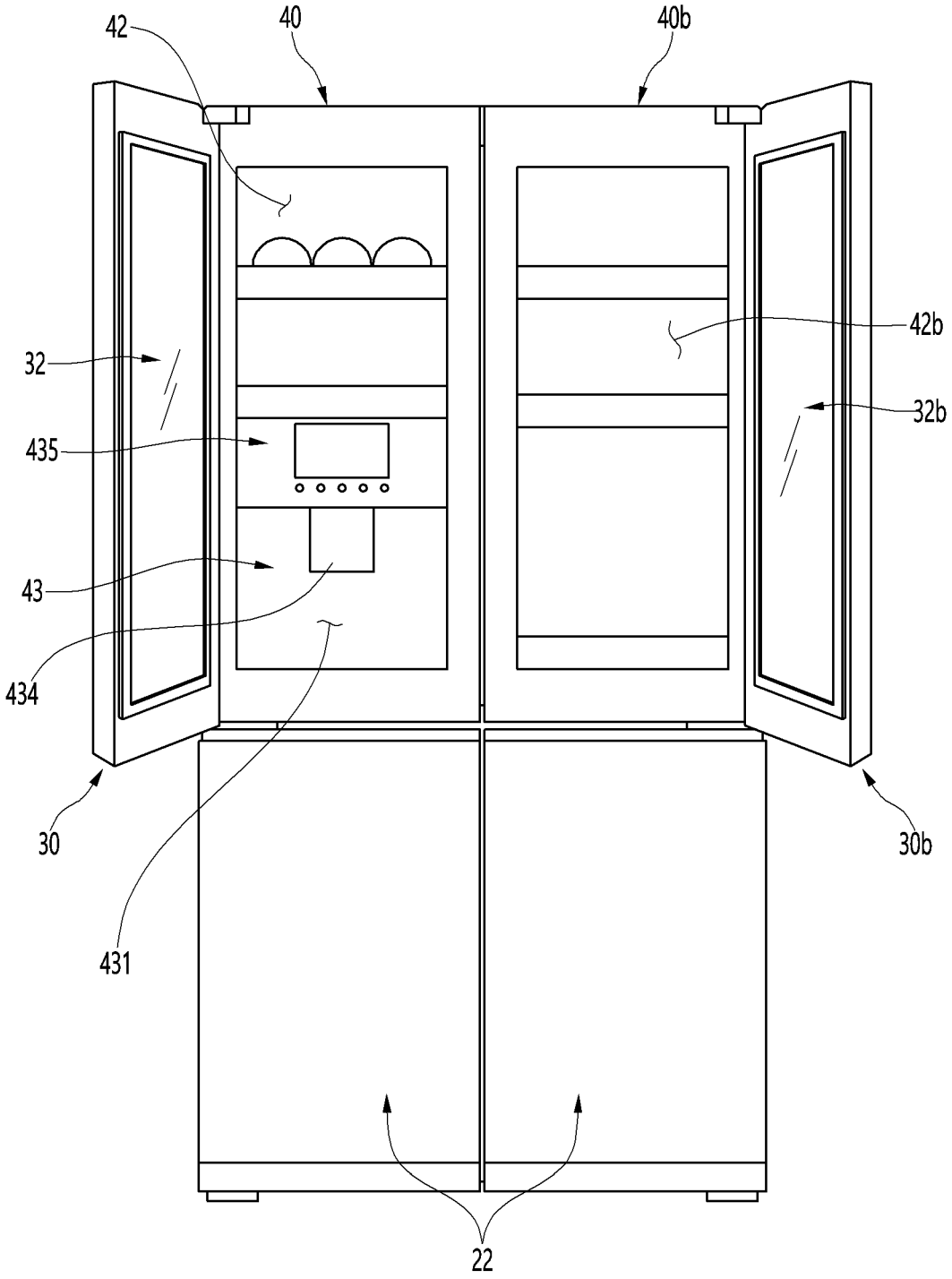
FIG. 4 is a front view illustrating a state in which a second door of the refrigerator is opened.

FIG. 1 is a front view of a refrigerator according to a first embodiment. In addition, FIG. 2 is a front view illustrating a state in which a door of the refrigerator is opened. In addition, FIG. 3 is a view illustrating a cold air flow state between a cabinet and an ice-making chamber. In addition, FIG. 4 is a front view illustrating a state in which a second door of the refrigerator is opened.

As illustrated in the drawings, a refrigerator 1 according to a first embodiment may include a cabinet 10 in which a storage space is defined, and a door that opens and closes the storage space.

For example, the storage space may be divided vertically, and a refrigerating compartment 11 may be provided at an upper side, and a freezing compartment 12 may be provided at a lower side. Each of the refrigerating compartment 11 and the freezing compartment 12 may be maintained at a set temperature by supplying cold air generated by an evaporator 14. As an example, the evaporator 14 may be provided in the freezing compartment 12, and the cold air may be supplied to the refrigerating compartment 11 and the freezing compartment 12 by driving a blowing fan 16 provided in the freezing compartment 12.

In addition, the cabinet 10 may be provided with a cabinet duct 15 that supplies the cold air to the ice-making chamber 50, which will be described below. The cabinet duct 15 may be provided to guide a flow of the cold air between the evaporator 14 and the refrigerating compartment door 21 in which the ice-making chamber 50 is provided. Then, in a state in which the refrigerating compartment door 21 is closed, the refrigerating compartment door 21 may communicate with the ice-making chamber 50 to guide the cold air generated in the evaporator 14 to the ice-making chamber 50, and air that is heat-exchanged in the ice-making chamber 50 may be collected again toward the evaporator 14.

As another example, the evaporator may be provided in each of the refrigerating compartment 11 and the freezing compartment 12, and the cabinet duct 15 may be configured so that one side of the refrigerating compartment 11, in which the evaporator is disposed, communicates with the ice-making chamber 50.

The door 20 may include a refrigerating compartment door 21 that opens and closes the refrigerating compartment 11 and a freezing compartment door 22 that opens and closes the freezing compartment 12. A pair of the refrigerating compartment door 21 and the freezing compartment door 22 may be provided at each of both left and right sides to open and close the refrigerating compartment 11 or the freezing compartment 12.

At least one of the doors 20 may have a double door structure constituted by a first door 40 and a second door 30. The first door 40 may be called an inner door, and the second door 30 may be called an outer door. In addition to the refrigerator 1 having the structure provided as an example, the door may be applied to various types of refrigerators having the double door structure. As another example, the present disclosure may be applied to a refrigerator having a structure in which a refrigerating compartment and a freezing compartment are disposed at left and right sides and a refrigerator having a structure in which a freezing compartment is provided at a lower side, and a refrigerating compartment is provided at an upper side.

Upper and lower ends of the first door 40 may be axially coupled to the cabinet 10 by a hinge device. Thus, the first door 40 may be rotatably mounted on the cabinet 10. Also, the first door 40 may open and close the refrigerating compartment 11 by the rotation thereof. In addition, the second door 30 may be rotatably mounted on the first door 40. The second door 30 may be provided in front of the first door 40 and may rotate to shield a front surface of the first door 40.

When the door storage portion and the dispenser 43 are disposed in the first door 40, the second door 30 may shield the door storage portion 42 and the dispenser 43. That is, when the second door 30 is closed, the door storage portion 42 and the dispenser 43 may not be visible to providing a simple and neat appearance by the second door 30. At the same time, when the second door 30 is opened, auxiliary storage of food may be possible through the door storage portion 42, and water or ice may be dispensed through the dispenser 43. Thus, the refrigerator 1 may simultaneously improve the outer appearance and usability.

The second door 30 may be configured so that a rear side of the second door 30, that is, the door storage portion 42, is visible. A see-through portion 321 capable of seeing the rear side may be provided on at least a portion of the front surface of the second door 30. When the door storage portion 42 and the dispenser 43, which will be described below, are disposed in the first door 40, the door storage portion 42 and the dispenser 43 may be seen through the see-through portion 321 without opening the second door 30. The see-through portion 321 may be provided by a panel assembly 32 that defines a front surface of the second door 30.

Figure 8:
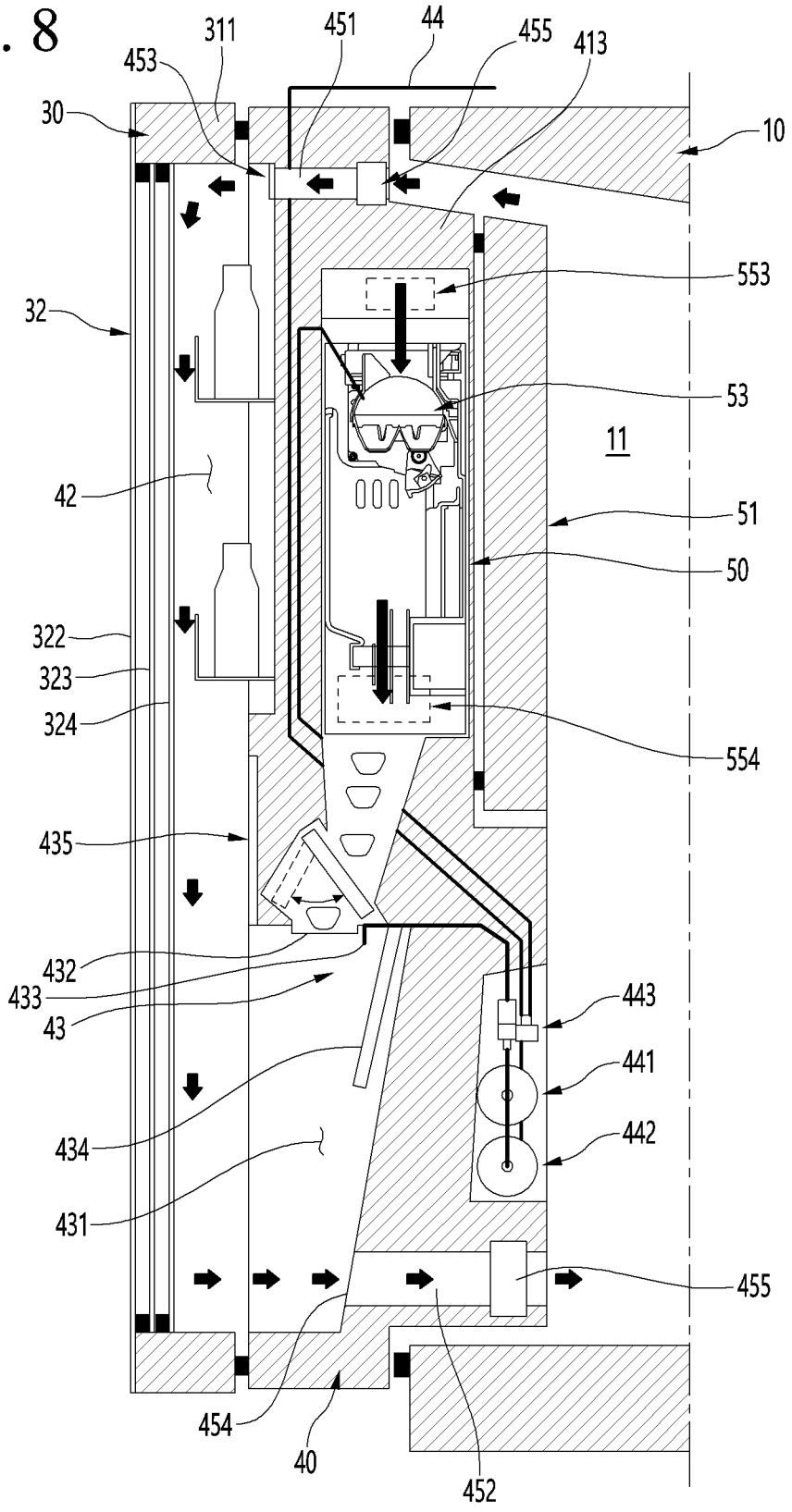
FIG. 8 is a cross-sectional view taken along line A-A of FIG. 1 according to the first embodiment.

As an example, the second door 30 may include the panel assembly 32 provided by a combination of a plurality of transparent plates 322, 323, and 324. As an example, as illustrated in FIG. 8, the transparent plates 322, 323, and 324 may be made of tempered glass or insulating glass and may be spaced apart from each other in a front and rear direction. In addition, the first door 40 may be provided with a door light 46 that illuminates the door storage portion 42. As the door light 46 is turned on and off, the rear side of the second door 30 may become bright and may be visualized through the see-through portion 321. The door light 46 may be provided within the door storage portion 42. Also, the door light 46 may be provided on the second door 30. The door light 46 may be turned on and off by user's manipulation or may be turned on and off by detecting user's proximity.

For example, a transparent display may be provided between the plurality of transparent plates 322, 323, and 324 to enable a screen output. Thus, both transparency and screen display of the door storage portion 42 may be possible through the second door 30. Here, the transparent display may be disposed on only one of the refrigerating compartment doors disposed 21 at both left and right sides.

Figure 12:
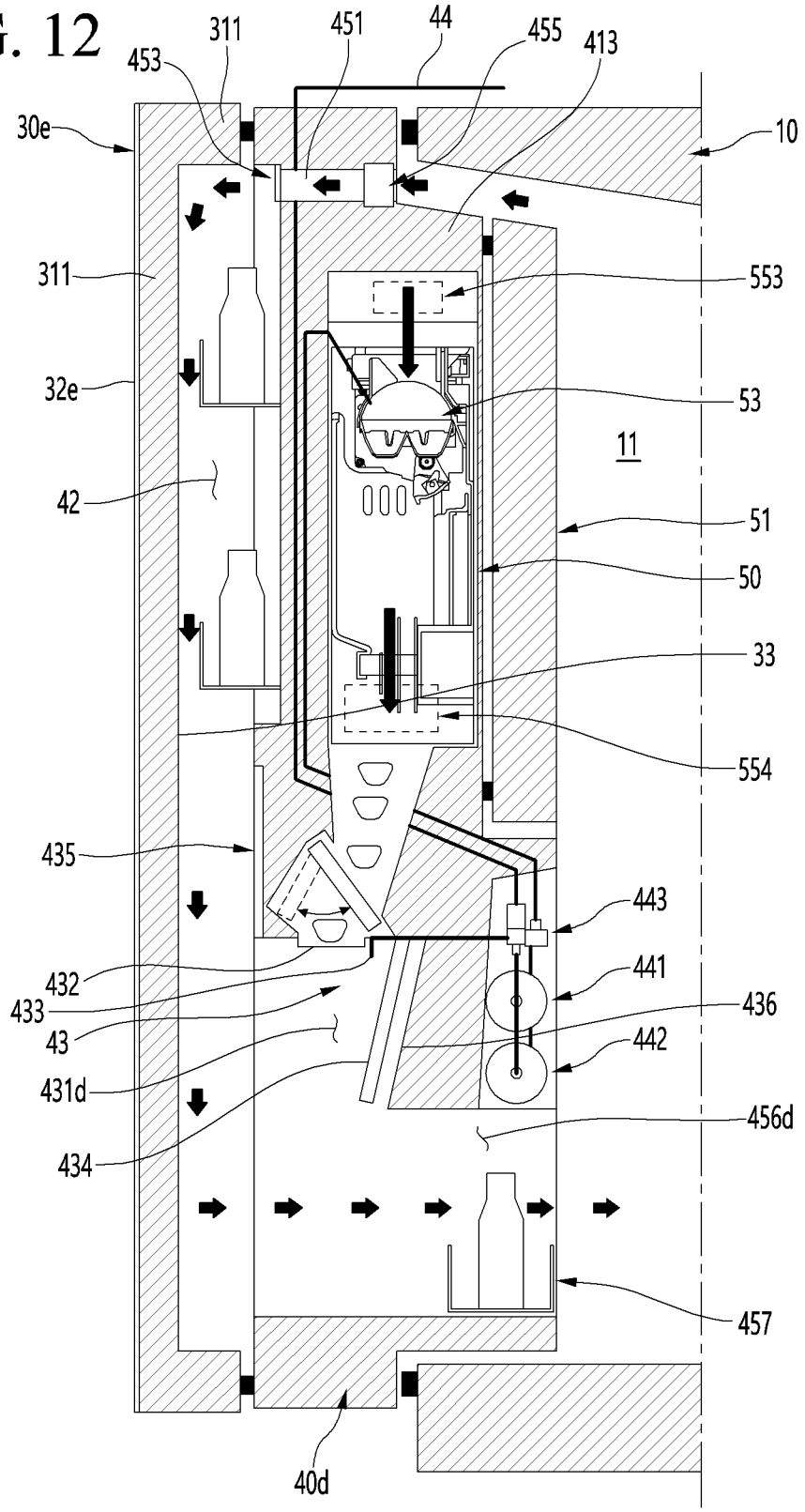
FIG. 12 is a cross-sectional view taken along line A-A of FIG. 1 according to a fourth embodiment.

In some implementations, the second door 30 may not include the panel assembly 32. The second door 30 may be configured so that an insulating material is entirely filled into the second door as illustrated in FIG. 12, and the door accommodation portion 42 is not seen from the outside.

This double door structure may be applied to the refrigerating compartment door 21. In addition, each of the pair of refrigerating compartment doors 21 may be configured as the double door structure.

For example, the refrigerating compartment door 21 may be constituted by a left door 21*a* and a right door 21*b*. In addition, the left door 21*a* may be constituted by a first door 40 and a second door 30. In addition, an ice-making chamber 50 may be provided in the rear surface of the first door 40, and the door storage portion 42 and the dispenser 43 may be provided in the front surface of the first door 40. In addition, the second door 30 may open and close the door storage portion 42 and the dispenser 43.

The right door 21*b* may be constituted by a first door 40*b* and a second door 30*b*. In addition, the first door 40*b* may be provided with a door storage portion 42*b*. Also, the second door 30*b* may open and close the door storage portion 42*b*.

Here, the door storage portion 42*b* of the right door 21*b* may have a longer vertical length and deeper recessed structure compared to the door storage portion 42 of the left door 21*a*. In addition, see-through portions 321 and 321*b* may be provided in both the second doors 30 and 30*b*, respectively, and thus, even when the second doors 30 and 30*b* are closed, both the door storage portions 42 and 42*b* and the dispenser 43 may be seen through the see-through portions 321 and 321*b*.

The ice-making chamber 50 and the dispenser 43 may be provided in one door of the left door 21*a* and the right door 21*b*. Hereinafter, the structure in which the ice-making chamber 50 and the dispenser 43 are provided in the left door 21*a* of the refrigerating compartment door 21 will be described in more detail with reference to the drawings. For convenience of explanation, hereinafter, the left door 21*a* may be referred to as the refrigerating compartment door 21.

Figure 5:
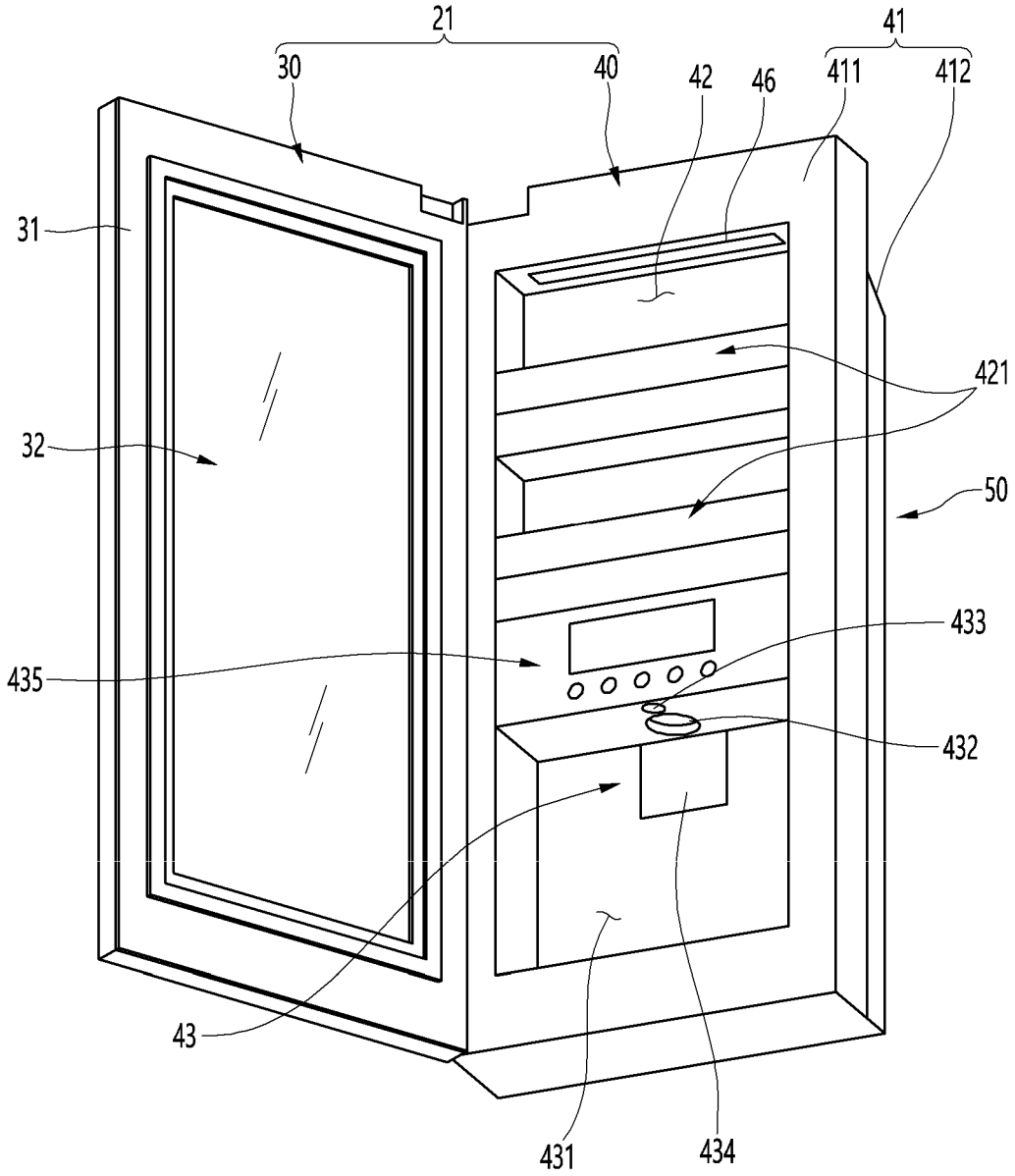
FIG. 5 is a perspective view illustrating a refrigerating compartment door with the second door opened when viewed from one side.
Figure 6:
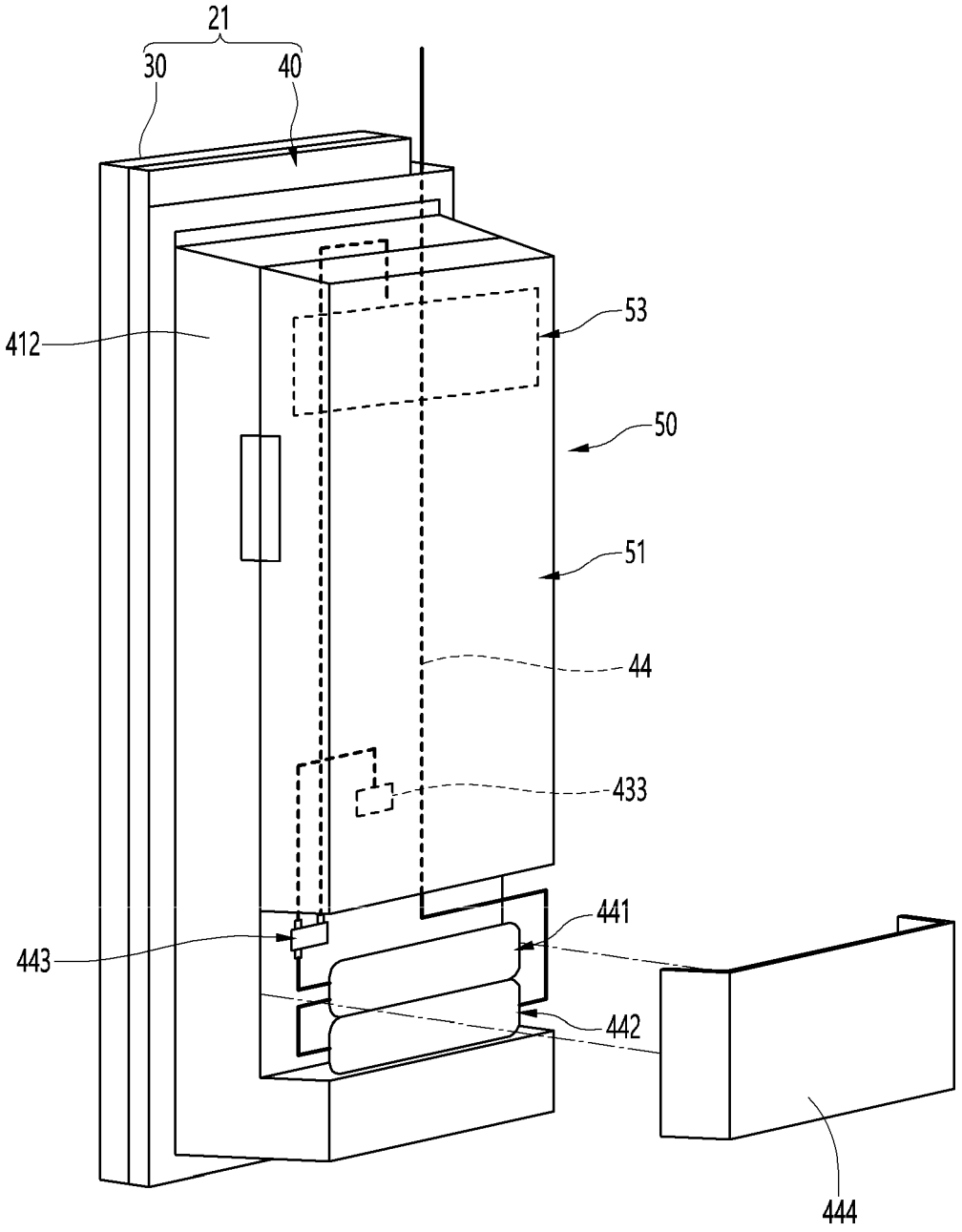
FIG. 6 is a perspective view illustrating the refrigerating compartment door with the second door opened when viewed from the other side.

FIG. 5 is a perspective view illustrating the refrigerating compartment door with the second door opened when viewed from one side. In addition, FIG. 6 is a perspective view illustrating the refrigerating compartment door with the second door opened when viewed from the other side.

As illustrated in the drawings, the ice-making chamber 50 may be provided in the refrigerating compartment door 21. The ice-making chamber 50 may be provided in the first door 40. The ice-making chamber 50 may be recessed from the rear surface of the first door 40 to define an ice-making space 500. In addition, an ice maker 53 may be provided inside the ice-making chamber 50. An ice bank 54 may be further provided inside the ice-making chamber 50. The ice bank 54 may be disposed below the ice maker 53 to store ice transferred from the ice maker 53. In addition, the ice bank 54 may communicate with the dispenser 43 through an ice chute.

In addition, an ice-making chamber door 51 may be provided on a rear surface of an opening of the ice-making chamber 50 to open and close the ice-making chamber 50. The ice-making chamber 50 and the ice-making chamber door 51 may be made of an insulating material to insulate the refrigerating compartment 11 from the door storage portion 42 of the first door 40.

The door storage portion 42 may be disposed on the front surface of the first door 40. The door storage portion 42 may be recessed from the front surface of the first door 40. The door storage portion 42 may be called a door storage space. The door storage portion 42 may be provided with a plurality of storage members 421. As an example, the storage member 421 may be a basket.

The first door 40 may include a door body 41 filled with an insulating material 413 therein. The door body 41 may include a door case 411 defining a front surface thereof and a door liner 412 forming a rear surface thereof. In addition, the door storage portion 42 that is opened forward may be provided in the door case 411. In addition, the ice-making chamber 50 that is opened backward may be provided in the door liner 412.

Thus, the insides of the door storage portion 42 and the ice-making chamber 50 may be insulated. The insulating material 413 inside the first door 40 may be provided by injecting a foaming liquid. In addition, an additional insulating material having insulating performance that is superior to that of the insulating material 413 may be disposed between the ice-making chamber 50 and the door storage portion 42. As an example, the additional insulating material may be a vacuum insulating material.

In addition, cold air may be supplied to the door storage portion 42 and the ice-making chamber 50. As an example, the door storage portion 42 may communicate with the refrigerating compartment 11 to supply the cold air thereto. In addition, the ice-making chamber 50 may communicate with a space in which the evaporator 14 is disposed so that the cold air is supplied.

The first door 40 may be provided with the dispenser 43 that dispenses water or ice. The dispenser 43 may be provided at a lower portion of the first door 40. The door storage portion 42 may be provided at an upper portion of the first door 40, and the dispenser 43 may be provided below the door storage portion 42.

The door storage portion 42 may be disposed in front of the ice-making chamber 50 in the first door 40 to at least partially overlap the ice-making chamber 50. In addition, the dispenser 43 may be disposed below the ice-making chamber 50.

The dispenser 43 may communicate with the ice-making chamber 50, and ice inside the ice-making chamber 50 may be taken out through the dispenser 43. In addition, purified water may be dispensed through the dispenser 43. For this, the dispenser 43 may include a water dispensing portion 433 and an ice dispensing portion 432.

In detail, the dispenser 43 may include a dispenser recess portion 431 that is recessed from the front surface of the first door 40. The dispenser recess portion 431 may be disposed below the water dispensing portion 433 and the ice dispensing portion 432. In addition, a manipulation member 434 may be provided in the dispenser recess portion 431 to manipulate a dispensing operation for water or ice. The dispenser recess portion 431 may be a portion of the door storage portion 42.

A user may manipulate the manipulation member 434 in a state in which a cup or container is disposed in the dispenser recess portion 431 to dispense water or ice through the ice dispensing portion 433 and the ice dispensing portion 432.

In addition, the dispenser 43 may be shielded by the second door 30. In addition, the dispenser 43 may be selectively visible through the transparent panel assembly 32.

The second door 30 may be provided with a filter 442, a water tank 441, and a valve 443. The filter 442 may purify water supplied to the dispenser 43 and the ice maker 53. In addition, the water tank 441 may store the water purified by the filter 442. In addition, the valve 443 may be connected to the water tank 441 to operate so as to selectively supply water to the dispenser 43 and the ice maker 53.

The filter 442, the water tank 441, and the valve 443 may be provided at the lower portion of the first door 40 and may be disposed behind the dispenser recess portion 431. In addition, the filter 442, the water tank 441, and the valve 443 may be mounted at the lower portion of the first door 40 and shielded by the cover 444. The filter 442, the water tank 441, and the valve 443 may be mounted on the cover 444 and configured to be separated together when the cover 444 is separated.

A display 435 may be further provided on the first door 40. The display 435 may display an operation state of the refrigerator 1 including the dispenser 43. The display 435 may be provided above the dispenser 43. The display 435 may be disposed between the door storage portion 42 and the dispenser 43. The display 435 may shield a portion of the dispenser 43. The water dispensing portion 433 and the ice dispensing portion 432 may be disposed on a bottom surface of the display 435. In addition, the display 435 may be shielded by the second door 30. In addition, the display 435 may be selectively visible through the panel assembly 32.

The door storage portion 42 may be depressed from the front surface of the first door 40. In addition, the door storage portion 42 may be defined as an entire opened space in the front surface of the first door 40, which is opened and closed by the second door 30.

In this case, at least one of the storage member 421, the dispenser 43, or the display 435 may be provided inside the door storage portion 42. Here, the door storage portion 42 and the ice-making chamber 50 may be separated by the insulating material 413 in the first door 40 to define independent spaces.

The front surface of the first door 40 may be opened and closed by the second door 30. The second door 30 may define the front surface of the refrigerating compartment door 21 in a closed state. In addition, the second door 30 may shield the door storage portion 42, the dispenser 43, and the display 435 of the first door 40.

The second door 30 may include a door frame 31 defining a perimeter thereof, and the panel assembly 32 mounted on the door frame 31. The door frame 31 may have an opening that is penetrated to communicate with the door accommodation portion, and the panel assembly 32 may shield the opening. In addition, the insulating material 311 may be filled into the door frame 31 disposed along a circumference of the panel assembly 32.

In addition, the panel assembly 32 may overlap at least a portion of the door storage portion 42. In addition, the panel assembly 32 may overlap at least portions of the door storage portion 42 and the display 435.

Thus, when the door light 46 is turned on, the door storage portion 42 and the dispenser 43 may be seen from the outside through the see-through portion 321. In addition, when the display 435 is turned on, a state of the display 435 may be checked through the see-through portion 321.

In order to cool the ice-making chamber 50 and the door storage portion 42, the cold air may be supplied to each space.

Hereinafter, the structure in which the cold air is supplied to the ice-making chamber and the door storage portion will be described with reference to the drawings.

Figure 7:
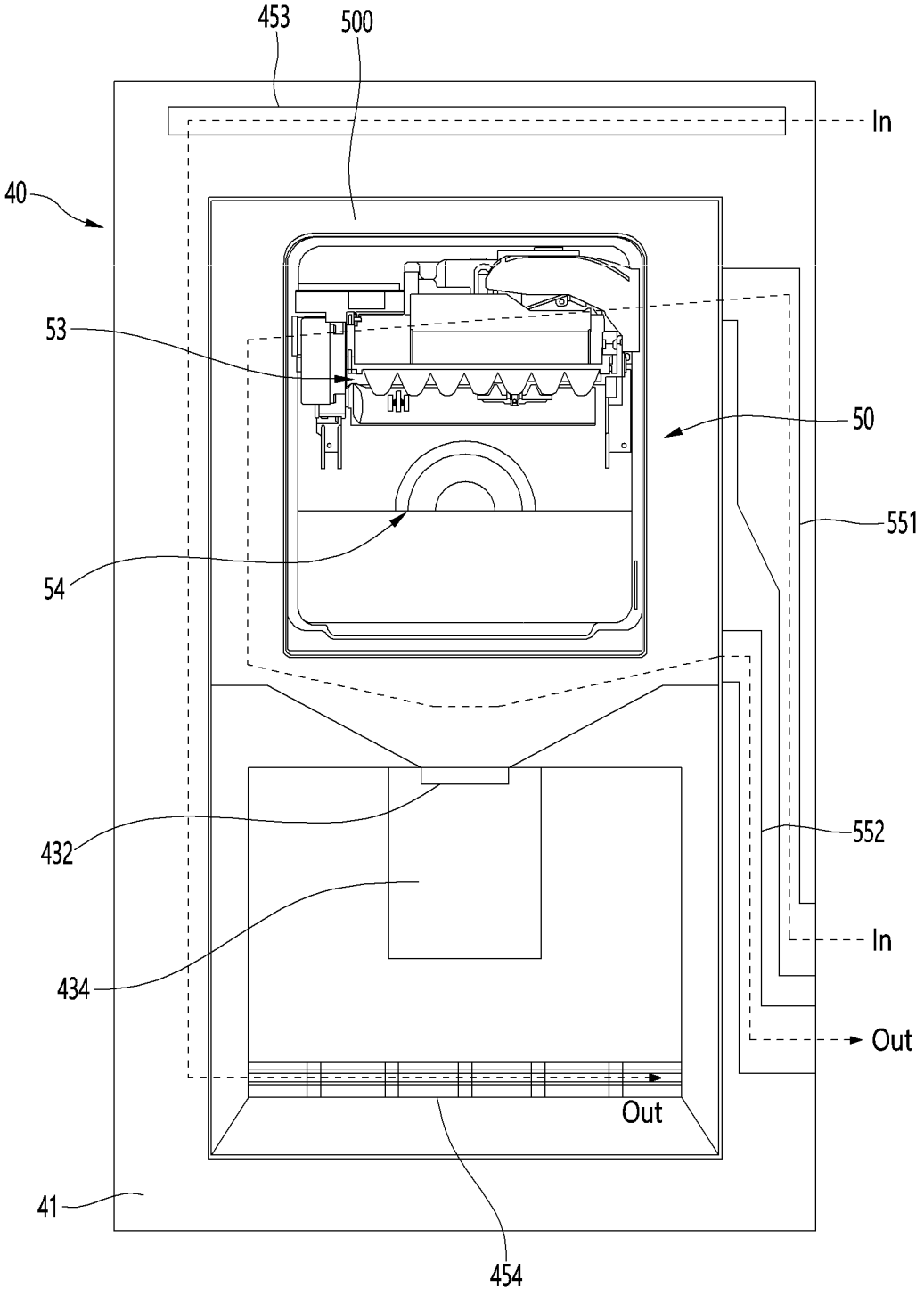
FIG. 7 is a view illustrating an arrangement of a cold air passage of a first door according to the first embodiment.

FIG. 7 is a view illustrating an arrangement of a cold air passage of the first door according to the first embodiment. In addition, FIG. 8 is a cross-sectional view taken along line A-A of FIG. 1 according to the first embodiment.

As illustrated in the drawings, the first door 40 may include an ice-making chamber duct 55. The ice-making chamber duct 55 may include an ice-making chamber supply duct 551 and an ice-making chamber return duct 552. The ice-making chamber supply duct 551 and the ice-making chamber return duct 552 may be disposed inside one surface of the first door 40.

One end of the ice-making chamber supply duct 551 may be opened at an upper portion of the ice-making chamber 50 to provide an ice-making chamber cold air inlet 553, and the other end may be opened to an outer surface of the first door 40 to communicate with a cabinet supply duct 151. In addition, one end of the ice-making chamber return duct 552 may be opened at a lower portion of the ice-making chamber 50 to provide an ice-making chamber cold air outlet 554, and the other end may be opened to an outer surface of the first door 40 to communicate with a cabinet return duct 152.

Thus, the cold air generated in the evaporator 14 may be supplied to the ice-making chamber 50 through the cabinet supply duct 151 and air heat-exchanged in the ice-making chamber may be disposed toward the freezing compartment 12 or the evaporator 14 through the ice-making chamber return duct 552 and the cabinet return duct 152. In this way, cooling of the ice-making chamber 50 and ice-making operation may be performed through circulation of the cold air between the space in which the evaporator 14 is disposed at one side of the cabinet 10 and the ice-making chamber 50.

In addition, the first door 40 may include a supply duct 451 and a discharge duct 452. The refrigerating compartment 11 and the door storage portion 42 may communicate with each other through the supply duct 451 and the discharge duct 452, and the door storage portion 42 may be cooled to a set temperature by the circulation of the cold air. Here, a temperature of the door storage portion 42 may be the same as that of the refrigerating compartment 11.

The supply duct 451 may be provided at the upper portion of the first door 40 to allow the door storage portion 42 to communicate with the refrigerating compartment 11. The supply duct 451 may be provided to pass through the front and rear surfaces of the first door 40.

The supply duct 451 may be opened at the upper portion of the door storage portion 42 and may define an inlet 453. The inlet 453 may be provided at an upper end or top surface of the door storage portion 42. Thus, the inlet 453 may extend in a left and right direction of the door storage portion 42. Thus, the cold air of the refrigerating compartment 11, which is introduced through the supply duct 451 may be supplied from the upper end of the door storage portion 42 through the inlet 453.

The discharge duct 452 may be opened at the lower portion of the first door 40 and may be configured to allow the door storage portion 42 to communicate with the refrigerating compartment 11. The discharge duct 452 may be provided to pass through the front and rear surfaces of the first door 40.

The discharge duct 452 may be opened at the lower portion of the door storage portion 42 and may define an outlet 454. The outlet 454 may be provided at a lower end of the door storage portion 42. The outlet 454 may extend in the left and right direction of the door storage portion 42. Thus, air in the door storage portion 42, which is discharged through the outlet 454 and the discharge duct 452, may be discharged into the refrigerating compartment 11. The outlet 454 may be provided in the dispenser recess portion 431.

The first door 40 may be provided with a storage portion fan 455. The storage portion fan 455 may force the cold air from the refrigerating compartment 11 to be supplied to the door storage portion 42. The storage portion fan 455 may be provided in the supply duct 451 or the discharge duct 452. Of course, the storage portion fan 455 may be disposed in both the supply duct 451 and the discharge duct 452.

The cold air of the refrigerating compartment 11 may be forcibly supplied to the door storage portion 42 by an operation of the storage portion fan 455 to cool the door storage portion 42, and the cold air introduced into the door storage portion 42 may flow along a rear surface of the second door 30. Here, the rear surface of the second door 30 may be a rear surface of the panel assembly 32 or the plate 324. In addition, the door storage portion 42 may be cooled by the cold air supplied therein.

The refrigerating compartment 11 and the door storage portion 42 may communicate with each other through the supply duct 451 and the discharge duct 452, and the forced circulation of cold air may be enabled by the storage portion fan 455. Thus, the refrigerating compartment 11 and the door storage portion 42 may be maintained at the same temperature. In addition, a temperature of the door storage portion 42 may be controlled by driving the storage portion fan 455. Here, the temperature of the door storage portion 42 may be higher than that of the refrigerating compartment 11.

In addition to the foregoing embodiment, various embodiments may be exemplified. Hereinafter, another embodiment of the present disclosure will be described in detail with reference to the drawings. In addition, since configurations that are not described below are the same as those of the above-described embodiments, detailed descriptions and illustrations thereof will be omitted to prevent duplication of description, and the same reference numerals will be used for description. In addition, configurations that are not shown may refer to the above-described embodiments. That is, hereinafter, only the configurations that are different from those of the above-described embodiment will be described in detail.

Figure 9:
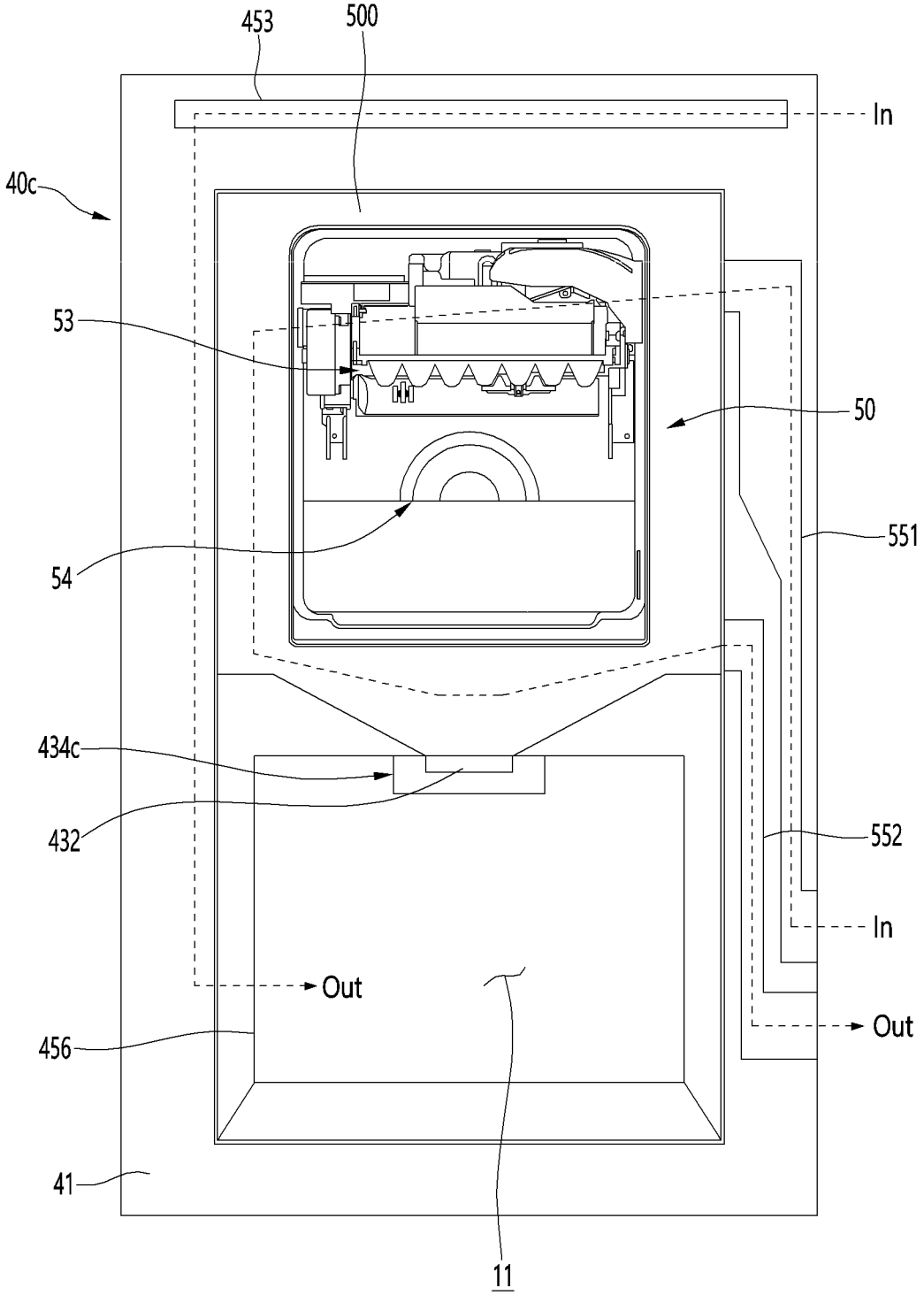
FIG. 9 is a view illustrating an arrangement of a cold air passage of a first door according to a second embodiment.
Figure 10:
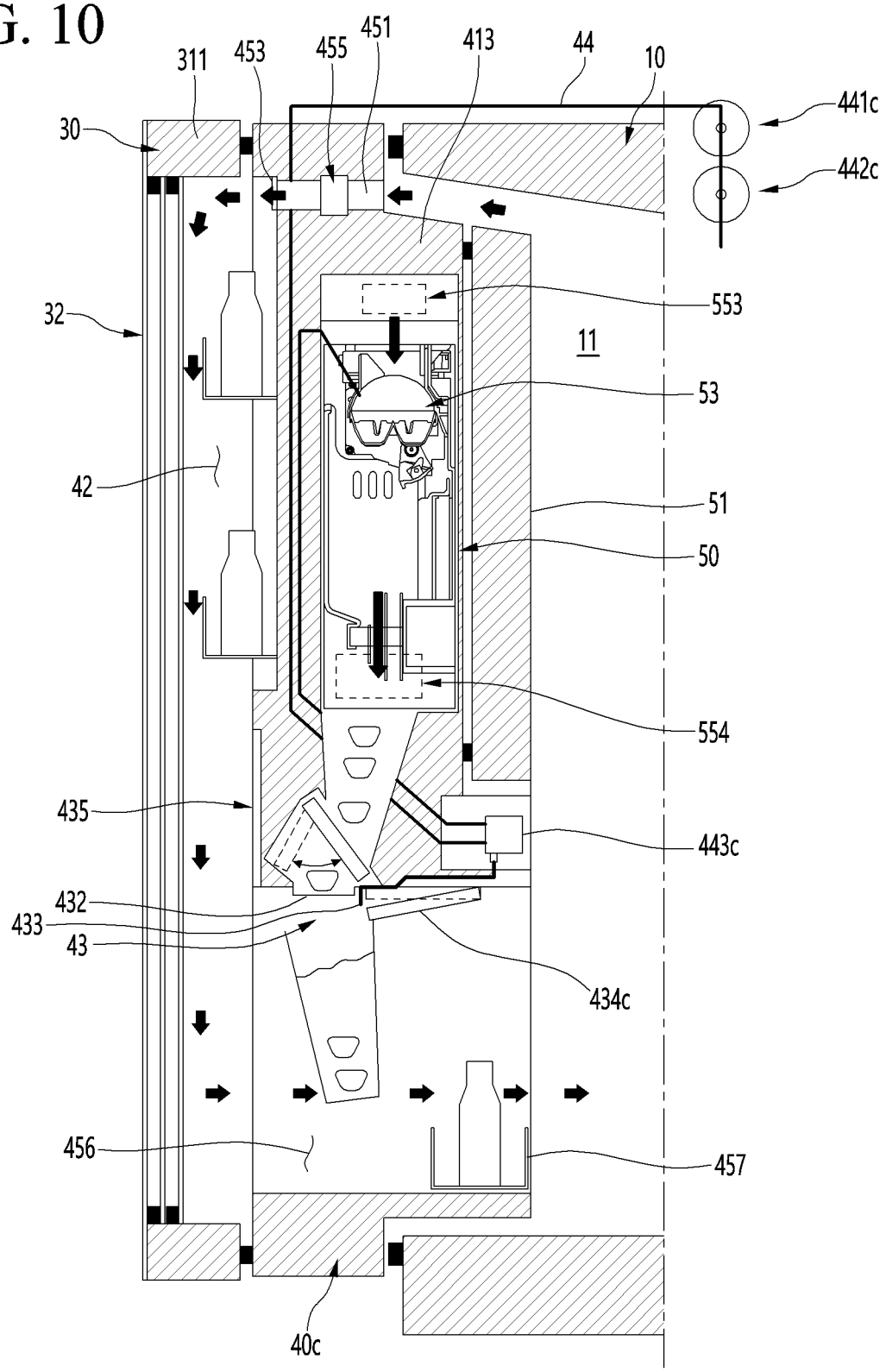
FIG. 10 is a cross-sectional view taken along line A-A of FIG. 1 according to the second embodiment.

FIG. 9 is a view illustrating an arrangement of a cold air passage of a first door according to a second embodiment. In addition, FIG. 10 is a cross-sectional view taken along line A-A of FIG. 1 according to the second embodiment.

As illustrated in the drawings, in a refrigerator 1 according to a second embodiment, a first door 40*c* may be provided with an ice-making chamber supply duct 551 and an ice-making chamber return duct 552, and thus, cold air of an evaporator 14 may be supplied to an ice-making chamber 50 to cool the ice-making chamber 50, thereby performing an ice-making operation.

In addition, an insulating material 413 may be filled into a first door 40*c*, and the ice-making chamber may be surrounded by the insulating material 413. Thus, the door storage portion 42 and the ice-making chamber 50 may be separated from each other by the insulating material 413 and thus be insulated from each other.

The first door 40*c* may be provided with a supply duct 451. The supply duct 451 may be provided at an upper portion of the first door 40*c* to allow a door storage portion 42 to communicate with a refrigerating compartment 11. The supply duct 451 may be provided to pass through front and rear surfaces of the first door 40. The supply duct 451 may be opened at an upper portion of the door storage portion 42 and may form an inlet 453. Thus, cold air inside the refrigerating compartment 11 may be supplied to the door storage portion 42 through the supply duct 451 and the inlet 453.

A storage portion fan 455 may be further provided in the supply duct 451. The cold air in the refrigerating compartment 11 may be forcibly supplied to the door storage portion 42 by driving the storage portion fan 455.

A through-portion 456 passing through the first door 40*c* in a front and rear direction may be provided at a lower portion of the first door 40*c*. The through-portion 456 may pass through most of the lower portion of the first door 40*c*, except for the door storage portion 42 and a display 435.

The door storage portion 42 and the refrigerating compartment 11 may communicate with each other through the through-portion 456. Therefore, the cold air introduced into the door storage portion 42 through the inlet 453 may flow downward of the door storage portion 42 and then be discharged to the refrigerating compartment 11 through the through-portion 456 disposed at the lower portion of the first door 40*c*. Thus, the refrigerating compartment 11 and the door storage portion 42 may communicate with each other and thus be maintained at the same temperature.

The first door 40*c* may include a dispenser 43*c*. The dispenser 43*c* may be configured to dispense ice made in an ice-making chamber 50 or purified water and may be provided in the through-portion 456.

The dispenser 43*c* may be provided on a top surface of the through-portion 456. The dispenser 43 may include an ice dispensing portion 432 and a water dispensing portion 433. The ice dispensing portion 432 may communicate with the ice-making chamber 50, and ice inside the ice-making chamber 50 may be discharged. The ice dispensing portion 432 may be disposed on the top surface of the through-portion 456. In addition, the water dispensing portion 433 may be disposed adjacent to the ice dispensing portion 432 and may be disposed on the top surface of the through-portion 456.

The dispenser 43*c* may include a manipulation member 434*c*. The manipulation member 434*c* may have a lever-like structure and may be provided on the top surface of the through-portion 456. The manipulation member 434*c* may be provided on the ice dispensing portion 432. The ice dispensing portion 432 or the water dispensing portion 433 may be opened and closed by manipulating the manipulation member 434*c* to discharge ice or water. The manipulation member 434*c* may have various structures that recognize user manipulation such as a button, a switch, and a touch sensor.

The manipulation member 434*c* may be manipulated in a vertical direction and may not substantially occupy an internal space of the through-portion 456. In addition, since the manipulation member 434*c* is disposed adjacent to the ice dispensing portion 432, the manipulation member 434 may be manipulated through an intuitive operation of bringing a cup or container toward the ice dispensing portion 432. In addition, the manipulation member 434*c* may be manipulated while bringing the cup or container close to the ice dispensing portion 432 to prevent water or ice from being scattered and more easily confirm the dispensing of the water or ice.

The through-portion 456 may extend from the ice dispensing portion 432 up to a lower end of the first door 40*c*. In addition, the remaining horizontal portion excluding the left and right ends of the first door 40*c* may be opened. Thus, access to the inside of the refrigerating compartment 11 may be possible through the through-portion 456.

A storage member 457 such as a separate door basket may be disposed inside the through-portion 456. That is, the storage member 457 in which food is stored may be disposed on an inner bottom surface of the through-portion 456. The through-portion 456 may provide a separate storage space in the first door 40*c*. Thus, the door storage portion 42 may be referred to as a first door storage portion 42, and the through-portion 456 may be referred to as a second door storage portion. In addition, when an entire recessed space of the first door 40*c* shielded by the second door 30 is referred to as the door storage portion 42, the through-portion 456 may be referred to as a portion of the door storage portion 42.

A lower portion of the first door 40*c* may be opened in the front and rear direction due to the through-portion 456, and since the ice-making chamber 50 is disposed at the upper portion of the first door 40*c*, a space in which a filter 442*c* and a water tank 441*c* are disposed may not be secured. Thus, the water tank 441*c* and the filter 442*c* for supplying water to the dispenser 43 and the ice maker 53 may be provided in a cabinet 10. In addition, a tube 44 connected to the water tank 441*c* and the filter 442*c* may be introduced into the first door 40 through a hinge device 131 and may be branched from the valve 443*c* inside the first door 40 and be connected to the dispenser 43 and the ice maker 53.

In addition, the second door 30 may be provided in front of the first door 40*c*, and the second door 30 may shield the door storage portion 42, the display 435, and the through-portion 456. The second door 30 may include a transparent panel assembly 32, and a see-through portion 321 may be provided. Therefore, even when the second door 30 is closed, when the door light 46 is turned on, the door storage portion 42 and the through-portion 456 may be visible through the see-through portion 321.

In some examples, the second door 30 may not include the panel assembly 32. The second door 30 may be configured so that an insulating material is entirely filled into the second door as illustrated in FIG. 12, and the door accommodation portion 42 is not seen from the outside.

Figure 11:
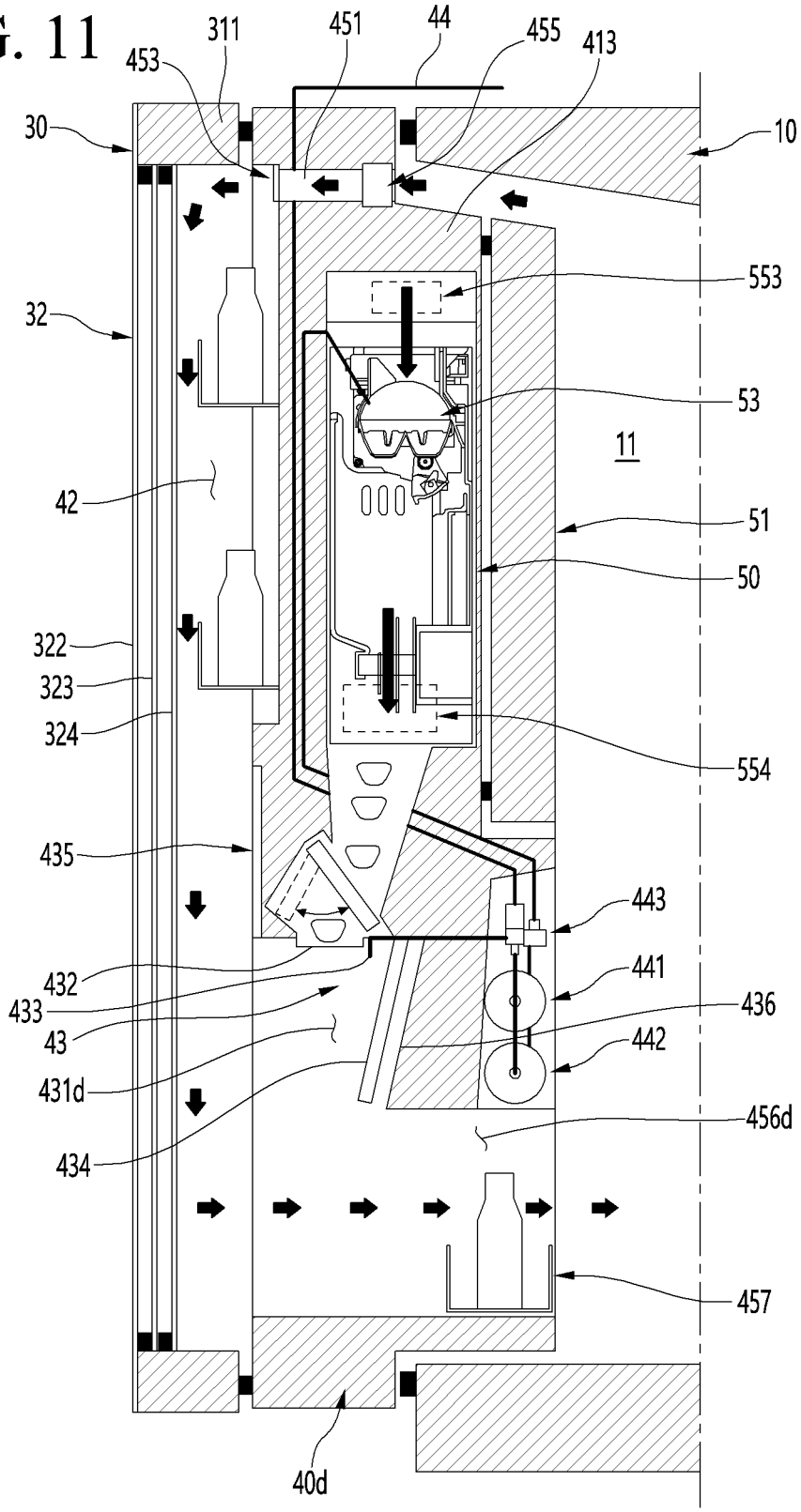
FIG. 11 is a cross-sectional view taken along line A-A of FIG. 1 according to a third embodiment.

FIG. 11 is a cross-sectional view taken along line A-A of FIG. 1 according to a third embodiment.

As illustrated in the drawing, a refrigerator according to a third embodiment may include a door that opens and closes a storage space 11 of the cabinet 10. The door may be rotatably mounted on the cabinet 10 and may have a double door structure.

In detail, the door may include a first door 40*d* that shields the storage space, and a second door 30 provided in front of the first door 40*d*. The second door 30 may open and close the front surface of the first door 40*d* by rotating.

The first door 40*d* may be provided with an ice-making chamber supply duct 551 and an ice-making chamber return duct 552. The cold air may be supplied to the ice-making chamber 50 through the ice-making chamber cold air inlet 553 disposed on one end of the ice-making chamber supply duct 551 so that the ice-making chamber 50 is cooled, and an ice-making operation of the ice maker 53 is performed. In addition, air in the ice-making chamber 50 may be collected toward an evaporator 14 through the ice-making chamber cold air outlet 554 disposed at one end of the ice-making chamber return duct 552.

In addition, an insulating material 413 may be filled into a first door 40*d*, and the ice-making chamber may be surrounded by the insulating material 413. Thus, the door storage portion 42 and the ice-making chamber 50 may be separated from each other by the insulating material 413 and thus be insulated from each other.

The first door 40*d* may be provided with a supply duct 451. The supply duct 451 may be provided at an upper portion of the first door 40*d* to allow a door storage portion 42 to communicate with a refrigerating compartment 11.

The supply duct 451 may be provided to pass through front and rear surfaces of the first door 40*d*. The supply duct 451 may be opened at an upper portion of the door storage portion 42 and may form an inlet 453. Thus, cold air inside the refrigerating compartment 11 may be supplied to the door storage portion 42 through the supply duct 451 and the inlet 453. In addition, the supply duct 451 may be disposed higher than the ice-making chamber 50.

The supply duct 451 may be provided with a storage portion fan 455 to forcibly supply the cold air from the refrigerating compartment 11 to the door storage portion 42. In addition, air introduced into the door storage portion 42 through the inlet 453 may flow downward along the front surface of the first door 40*d* and the rear surface of the second door 30.

The dispenser 43 may be provided in the first door 40*d*. The dispenser 43 may be provided below the ice-making chamber 50 to communicate with the ice-making chamber 50.

The dispenser 43 may include a dispenser recess portion 431*d* that is recessed from the front surface of the first door 40. In addition, a water dispensing portion 433 and an ice dispensing portion 432 may be disposed on a top surface of the dispenser recess portion 431*d*. In addition, a manipulation member 434 may be provided in the dispenser recess portion 431*d* to manipulate a dispensing operation for water or ice.

A manipulation member mounting portion 436 may be disposed in the dispenser recess portion 431. The manipulation member mounting portion 436 may be disposed behind the manipulation member 434. In addition, the manipulation member mounting portion 436 may extend upward to be spaced apart from a bottom surface of the dispenser recess portion 431*d*. In addition, the manipulation member mounting portion 436 may extend to a position at which at least portion of the manipulation member 434 overlaps, to ensure the mounting and operation of the manipulation member 434.

In addition, a filter 442, a water tank 441, and a valve 443 may be provided on the rear surface of the first door 40*d* corresponding to the manipulation member mounting portion 436. Thus, water supplied from the outside may be stored in the water tank 441 after passing through the filter 442 and may be selectively supplied to the dispenser 43 and the ice maker 53 by the operation of the valve 443.

A through-portion 456 passing through the first door 40*c* in the front and rear direction may be provided at a lower portion of the first door 40*c*. The through-portion 456*d* may be defined inside the display recess portion 431*d*. In addition, the through-portion 456*d* may be defined below the manipulation member mounting portion 436. For example, the through-portion 456*d* may be defined by a bottom surface of the manipulation member mounting portion 436 in the bottom surface of the dispenser recess portion 431*d*.

The door storage portion 42 and the storage space 11 may communicate with each other through the through-portion 456. Therefore, the cold air introduced into the door storage portion 42 through the inlet 453 may flow downward of the door storage portion 42 and then be discharged to the storage space 11 through the through-portion 456. Thus, the storage space 11 and the door storage portion 42 may communicate with each other and thus be maintained at the same temperature. The storage space 11 may be a refrigerating compartment.

The through-portion 456*d* may extend from the manipulation member mounting portion 436 up to a lower end of the first door 40*c*. In addition, the remaining horizontal portion excluding the left and right ends of the first door 40*c* may be opened. Thus, access to the inside of the refrigerating compartment 11 may be possible through the through-portion 456*d*.

A storage member 457 such as a separate door basket may be disposed inside the through-portion 456*d*. That is, the storage member 457 in which food is stored may be disposed on an inner bottom surface of the through-portion 456*d*. The through-portion 456 may provide a separate storage space in the first door 40*c*. Thus, the door storage portion 42 may be referred to as a first door storage portion 42, and the through-portion 456*d* may be referred to as a second door storage portion. In addition, when an entire recessed space of the first door 40*d* shielded by the second door 30 is referred to as the door storage portion 42, the through-portion 456*d* may be referred to as a portion of the door storage portion 42.

In addition, the second door 30 may be provided in front of the first door 40*d*, and the second door 30 may shield the door storage portion 42, the display 435, and the through-portion 456*d*. The second door 30 may include the transparent panel assembly 32, and thus, the door storage portion 42, the display 435, and the through-portion 456 may be visible even when the second door 30 is closed.

A display 435 may be further provided on the first door 40.

FIG. 12 is a cross-sectional view taken along line A-A of FIG. 1 according to a fourth embodiment.

As illustrated in the drawing, a refrigerator according to a fourth embodiment may include a cabinet 10 in which a storage space 11 is defined, and a door that opens and closes the storage space 11.

The door may have a double door structure. The door may include a first door 40*d* that opens and closes the storage space 11, and a second door 30*e* that opens and closes the first door 40*d* at a front side. The storage space 11 may be a refrigerating compartment.

The first door 40*d* may be the same as that of the foregoing third embodiment. In addition, the first door 40*d* may have the same structure as each of the first doors 40, 40*c*, and 40*d* of any one of the above-described embodiments.

The first door 40*d* may have a door storage portion 42 in a front surface thereof and an ice-making chamber 50 in a rear surface thereof. An insulating material 413 may be provided inside the first door 40*d*, and the front door storage portion 42 and the rear ice-making chamber 50 may be insulated from each other by the insulating material 413. In addition, a dispenser 43 may be provided in the front surface of the first door 40*d*.

In addition, a through-portion 456*d* passing through the first door 40*d* may be defined in the lower portion of the first door 40*d*, i.e., the dispenser recess portion 431. The through-portion 456*d* may communicate with the storage space 11 to serve as a passage through which cold air from the door receiving portion 42 is discharged.

In addition, the through-portion 456*d* may serve as the storage space. For this, a storage member 457 such as a door basket may be disposed in the through-portion 456*d*.

The second door 30*e* may be provided in front of the first door 40*d* and may be rotatably mounted on the first door

40*d*. The second door 30*e* may shield an entire front surface of the first door 40*d* and may open and close the door storage portion 42. The front outer appearance of the refrigerator may be defined when the second door 30*e* is closed.

The front surface of the second door 30*e* may be defined by a door panel 32*e*. The door panel 32*e* may be made of various materials such as glass, metal, plastic, and a composite material. In addition, an insulating material 311 may be filled into the second door 30*e*. Thus, the door storage portion 42 may be thermally insulated by the insulating material 31. In addition, the cold air introduced into the door storage portion 42 may move along the rear surface 33 of the second door 30*e*.

Thus, the door storage portion 42 may be thermally insulated from the rear ice-making compartment 50 by the insulation material 413 of the first door 40*d* and may be thermally insulated from front external air by the insulation material 311 of the second door 30*e*. The cold air supplied into the door storage portion 42 may flow between the second door 30*e* and the first door 40*d*. In addition, the inside of the door storage portion 42 may be maintained at a set temperature by the supplied cold air.

The second door 30*e* may shield the door storage portion 42 in a closed state and may shield the dispenser 43 and the penetration part 456*d*.

Figure 13:
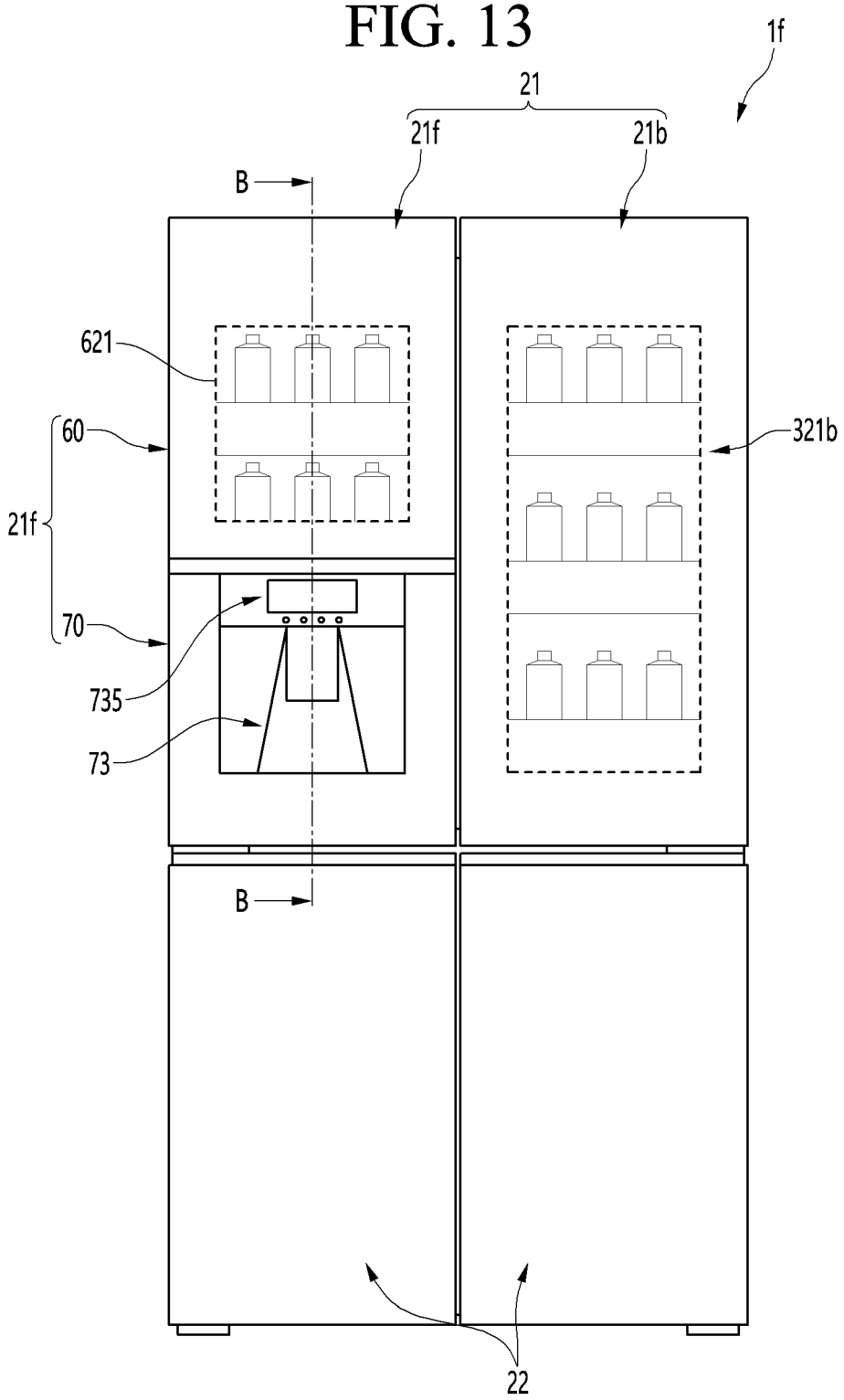
FIG. 13 is a front view of a refrigerator according to a fifth embodiment.
Figure 14:
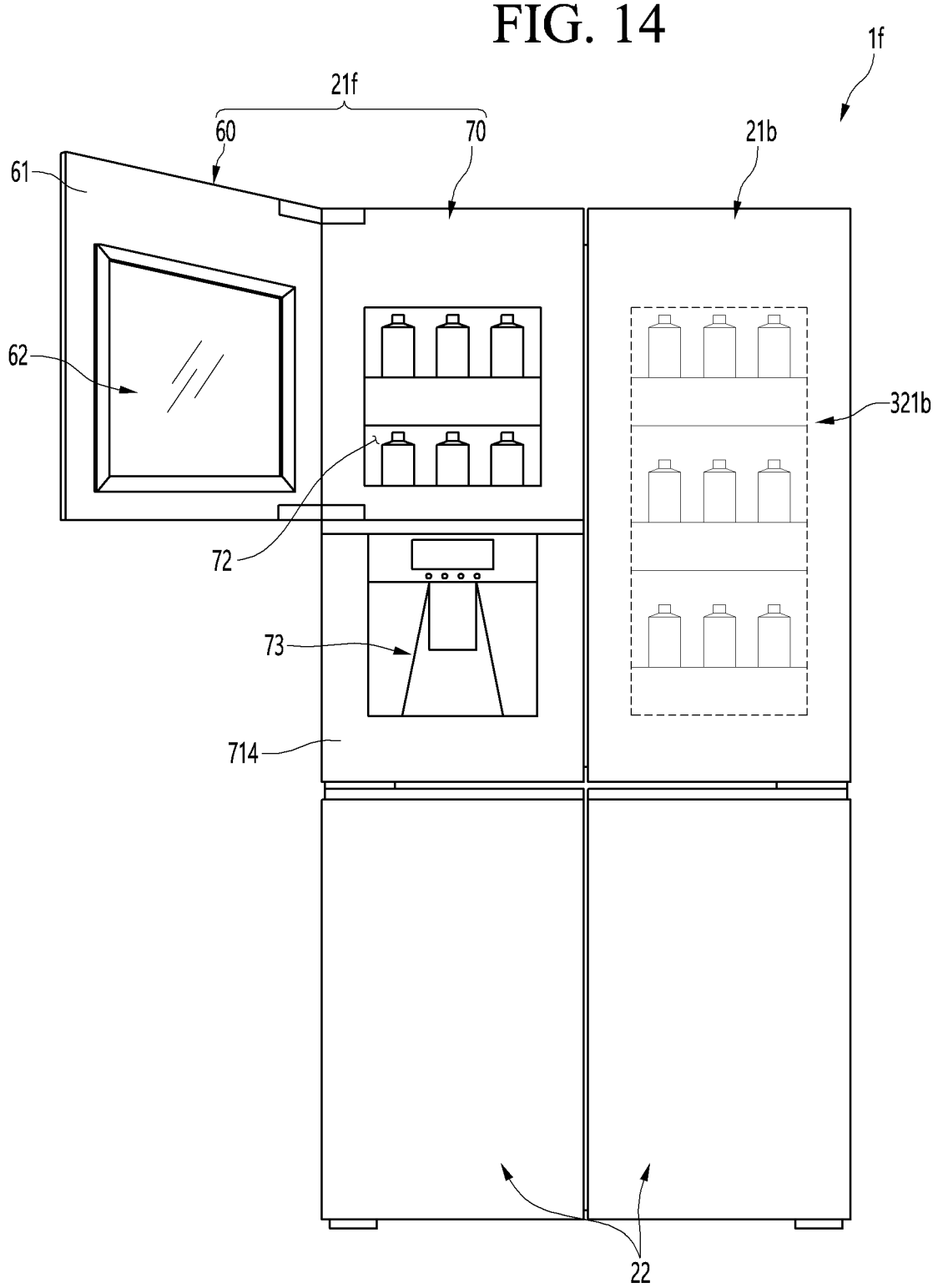
FIG. 14 is a front view illustrating a state in which a door of the refrigerator is opened.
Figure 15:
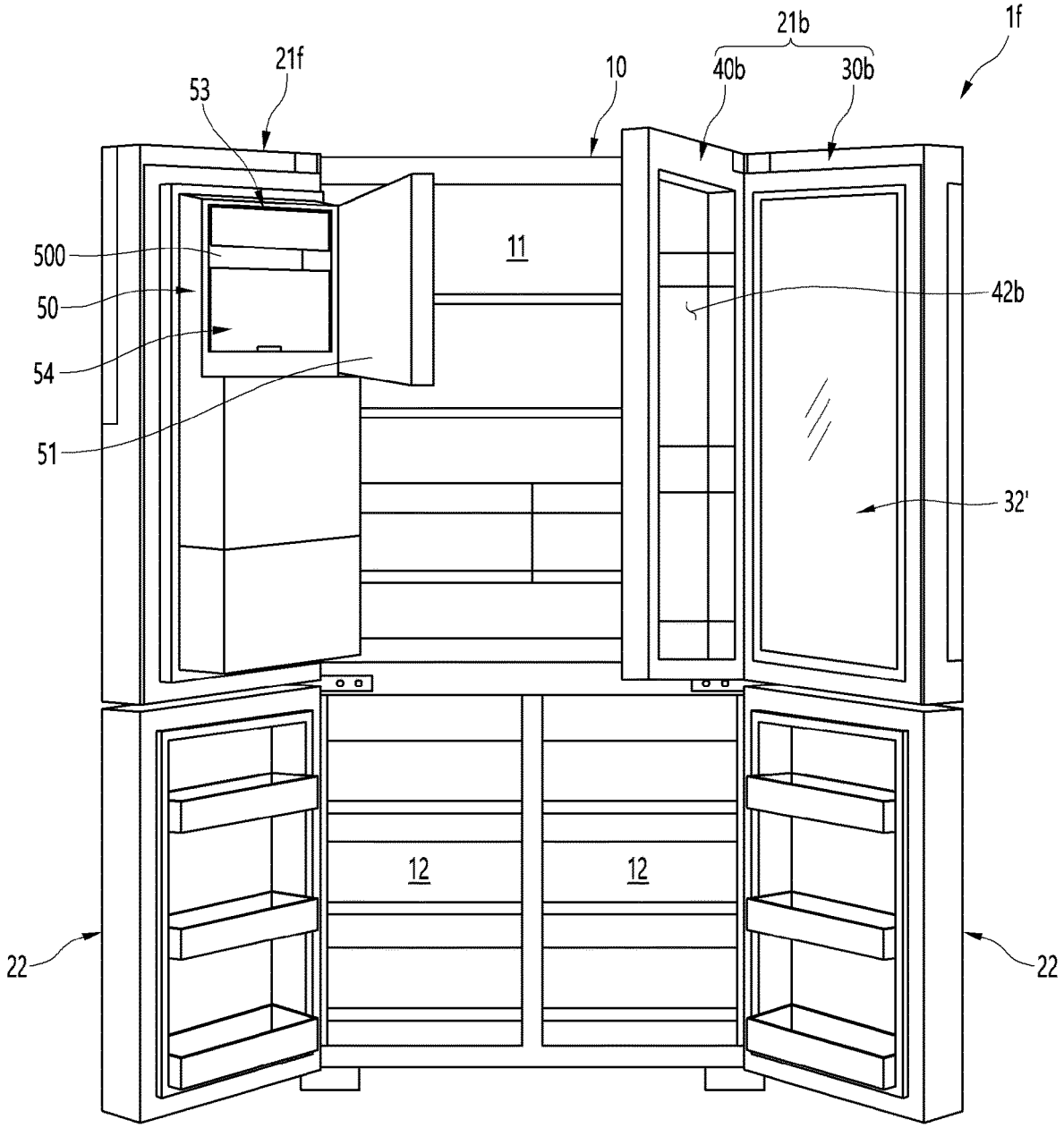
FIG. 15 is a front view illustrating a state in which a second door of the refrigerator is opened.
Figure 16:
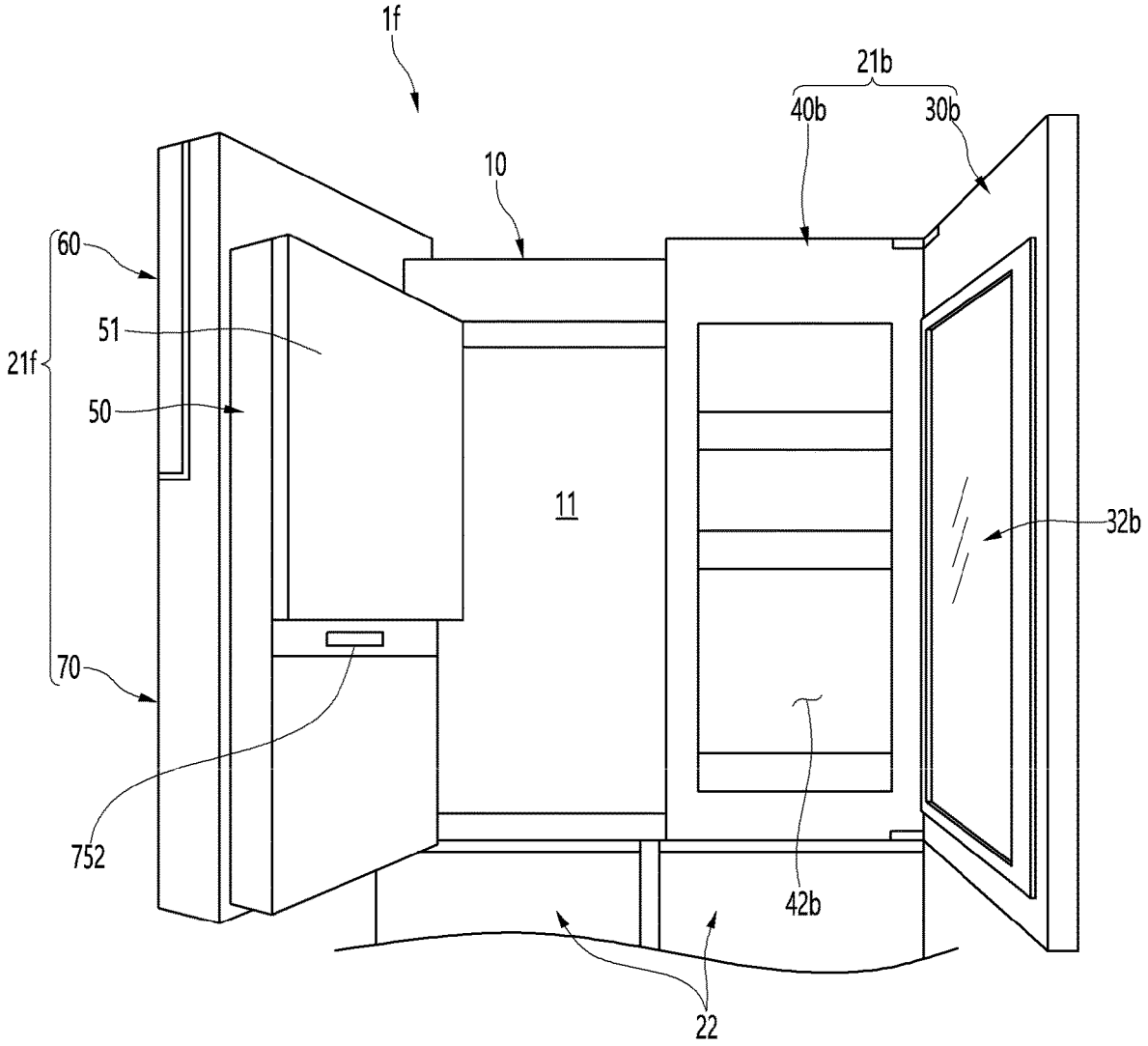
FIG. 16 is a perspective view illustrating a state in which a refrigerating compartment door of the refrigerator is opened.

FIG. 13 is a front view of a refrigerator according to a fifth embodiment. In addition, FIG. 14 is a front view illustrating a state in which a door of the refrigerator is opened. In addition, FIG. 15 is a front view illustrating a state in which a second door of the refrigerator is opened. In addition, FIG. 16 is a perspective view illustrating a state in which a refrigerating compartment door of the refrigerator is opened.

As illustrated in the drawings, a refrigerator 1*f* according to a fifth embodiment may be provided with a refrigerating compartment 11 and a freezing compartment 12, which are disposed at upper and lower portions of a cabinet 10, respectively, and may have a structure that opens and closes the refrigerating compartment 11 and the freezing compartment 12 by a refrigerating compartment door 21 and a freezing compartment door 22. A pair of refrigerating compartment door 21 and freezing compartment door 22 may be disposed at both left and right sides and may rotate to open and close the refrigerating compartment 11 and the freezing compartment 12.

At least one of the refrigerating compartment doors 21 may have a double door structure. In detail, the refrigerating compartment door 21 may include a left door 21*f* and a right door 21*b*, which are disposed on both left and right sides. In addition, each of the left door 21*f* and the right door 21*b* may have the double door structure.

For example, the right door 21*b* may include a first door 40*b* that shields the refrigerating compartment 11, and a second door 30*b* that opens and closes a door storage portion 42*b* provided in the first door 40*b*. The door storage portion 42*b* may be disposed on the right door 21*b*, and the door storage portion 42*b* may extend from an upper portion up to a lower portion of the first door 40*b*. In addition, the door storage portion 42*b* of the right door 21*b* may be provided to pass through the first door 40*b* and communicate with the refrigerating compartment 11. The second door 30*b* may shield an entire front surface of the first door 40*b* and may open and close the door storage portion 42*b*. In addition, the second door 30*b* may be provided with a transparent panel assembly 32*b*, and a see-through portion 321*b* may be provided to see the inside of the door storage portion 42*b*.

The left door 21*f* may include a first door 70 that shields the refrigerating compartment 11 and a second door 60 that opens and closes the door storage portion 72 provided in the first door 70. The left door 21*f* may be provided with an ice-making chamber 50, a dispenser 73, and a door storage portion 72. In addition, the second door 60 may be provided with a transparent panel assembly 62, and a see-through portion 621 may be provided to see the inside of the door storage portion 72.

Referring to the left door 21*f* in more detail, the ice-making chamber 50 may be provided in a rear surface of the first door 70. The ice-making chamber 50 may be disposed between the refrigerating compartment 11 and the door storage portion 72 and may be partitioned into a space independent of the refrigerating compartment 11 and the door storage portion 72 by an insulating material 713 disposed inside the first door 70. An ice maker 53 may be provided inside the ice-making chamber 50. In addition, an ice bank 54 in which ice transferred from the ice maker 53 is stored may be further provided inside the ice-making chamber 50. The ice-making chamber 50 may be provided with an ice-making chamber door 51 that opens and closes the ice-making chamber 50.

In addition, a dispenser 73 may be provided in a front surface of the first door 70. The dispenser 73 may include a dispenser recess portion 731 that is recessed from the front surface of the first door 70. In addition, a water dispensing portion 732 and an ice dispensing portion 733 may be provided on a top surface of the dispenser recess portion 731 to dispense water or ice. The dispenser 73 may not be shielded by the second door 60 and may be configured to be always exposed.

The dispenser 73 may be provided at a lower portion of the first door 70. The dispenser 73 may be disposed below the door storage portion 72 and may be provided at a lower portion of the first door 70. A protrusion 714 further protruding forward than the door storage portion 72 may be disposed on the lower portion of the first door 70. In addition, the dispenser may be provided on a front surface of the protrusion 714 to define a portion of an outer appearance of the front surface of the refrigerating compartment door 21.

In addition, a display 735 exposed to the outside may be further provided on the front surface of the first door 70. The display 735 may also be provided together with a portion of the dispenser 73.

The second door 60 may be provided in a size less than that of the first door 70 and may shield a portion of the first door 70. As an example, the second door 60 may be disposed above the protrusion 714 and be rotatably mounted on the first door 70 to open and close the door storage portion 72. The second door 60 may form the same plane as the front surface of the protrusion 714 in a closed state.

That is, the second door 60 and the door storage portion 72 may be disposed above the dispenser 73. When the second door 60 is closed, the front surface of the second door 60 may define the same plane as the front of the dispenser 73.

The second door 60 may include a door frame 61 defining a perimeter of the second door 60, and the panel assembly 62 mounted at an opened center of the door frame 61. The insulating material 611 may be filled inside the door frame 61. The panel assembly 62 may be constituted by a plurality of transparent plates so that the door storage portion 72 is selectively seen.

An upper portion of the first door 70 on which the second door 60 is disposed may be provided to be stepped. In addition, the ice-making chamber 50 may be provided at the upper portion of the first door 70 to protrude further backward than the lower portion of the first door 70. In addition, the door storage portion 72 may be disposed in front of the ice-making chamber 50 and may at least partially overlap the ice-making chamber 50.

Hereinafter, a structure in which cold air is supplied from the refrigerating compartment door 21 to the ice-making chamber 50 and the door storage portion 72 having the above structure will be described with reference to the drawings.

Figure 17:
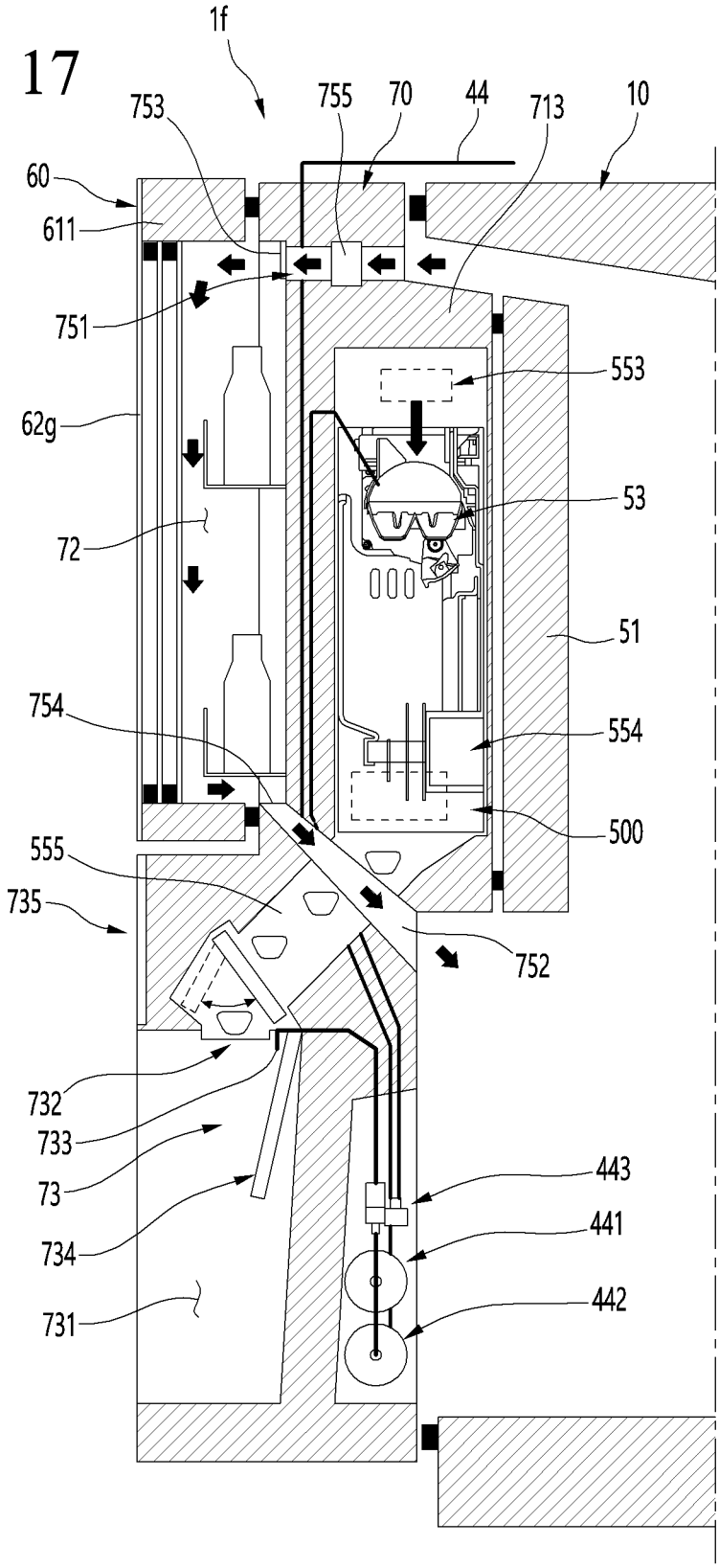
FIG. 17 is a cross-sectional view taken along line B-B of FIG. 11 according to a fifth embodiment.

FIG. 17 is a cross-sectional view taken along line B-B of FIG. 13 according to a fifth embodiment.

As illustrated in the drawing, the first door 70 may be provided with the ice-making chamber supply duct 551 and an ice-making chamber return duct 552. The cold air may be supplied to the ice-making chamber 50 through an ice-making chamber cold air inlet 553 disposed at one end of the ice-making chamber supply duct 551. In addition, air in the ice-making chamber 50 may be collected toward an evaporator 14 through the ice-making chamber cold air outlet 554 disposed at one end of the ice-making chamber return duct 552. Thus, the cold air may be circulated between a space in which the evaporator 14 at one side of the cabinet 10 is disposed and the ice-making chamber 50, and the inside of the ice-making chamber 50 may be cooled to a temperature at which an ice-making operation is possible.

The first door 70 may include a supply duct 751 and a discharge duct 752. The refrigerating compartment 11 and the door storage portion 72 may communicate with each other through the supply duct 751 and the discharge duct 752, and the door storage portion 72 may be cooled to a set temperature by the circulation of the cold air. Here, a temperature of the door storage portion 72 may be the same as that of the refrigerating compartment 11.

The supply duct 751 may be provided at the upper portion of the first door 70 to allow the door storage portion 72 to communicate with the refrigerating compartment 11. The supply duct 751 may be provided to pass through front and rear surfaces of the first door 40.

The supply duct 751 may be opened at the upper portion of the door storage portion 72 and may define an inlet 753. The inlet 753 may be provided at an upper end or top surface of the door storage portion 72. Thus, the inlet 753 may extend in a left and right direction of the door storage portion 72. Thus, the cold air of the refrigerating compartment 11, which is introduced through the supply duct 751 may be supplied from the upper end of the door storage portion 72 through the inlet 753.

The discharge duct 752 may be provided at the lower part of the door storage portion 72 and may define an outlet 754. The outlet 754 may be provided at a lower end of the door storage portion 72. In addition, the discharge duct 752 may be configured to allow the door storage portion 72 to communicate with the refrigerating compartment 11. The discharge duct 752 may be provided to pass through the front and rear surfaces of the first door 70 to allow air of the door storage portion 72 to be discharged into the refrigerating compartment 11.

The discharge duct 752 may be provided above the dispenser 73. The discharge duct 752 may be provided between the door storage portion 72 and the dispenser 73. In addition, the discharge duct 752 may extend in a direction intersecting an ice chute 555 connecting the ice-making chamber 50 to the dispenser 73. In addition, the discharge duct 752 may be provided between the door storage portion 72 and a lower end of the ice-making chamber 50.

The supply duct 751 and the discharge duct 752 may communicate with the door storage portion 72 and may pass above and below the ice-making chamber 50 to communicate with the refrigerating compartment 11. That is, the supply duct 751 and the discharge duct 752 may be configured to extend by bypassing the ice-making chamber 50 without passing through the ice-making chamber 50.

The cold air inside the refrigerating compartment 11 may be supplied to the upper portion of the door storage portion 72 through the supply duct 751. In addition, the air flowing into the lower portion of the door storage portion 72 may be discharged into the refrigerating compartment 11 through the discharge duct 752.

The supply duct 751 or the discharge duct 752 may be provided with a storage portion fan 755. Thus, the cold air of the refrigerating compartment may be effectively supplied to the door storage portion 72. In addition, the refrigerating compartment 11 and the door storage portion 72 may be maintained at the same temperature by supplying the cold air of the refrigerating compartment 11.

Figure 18:
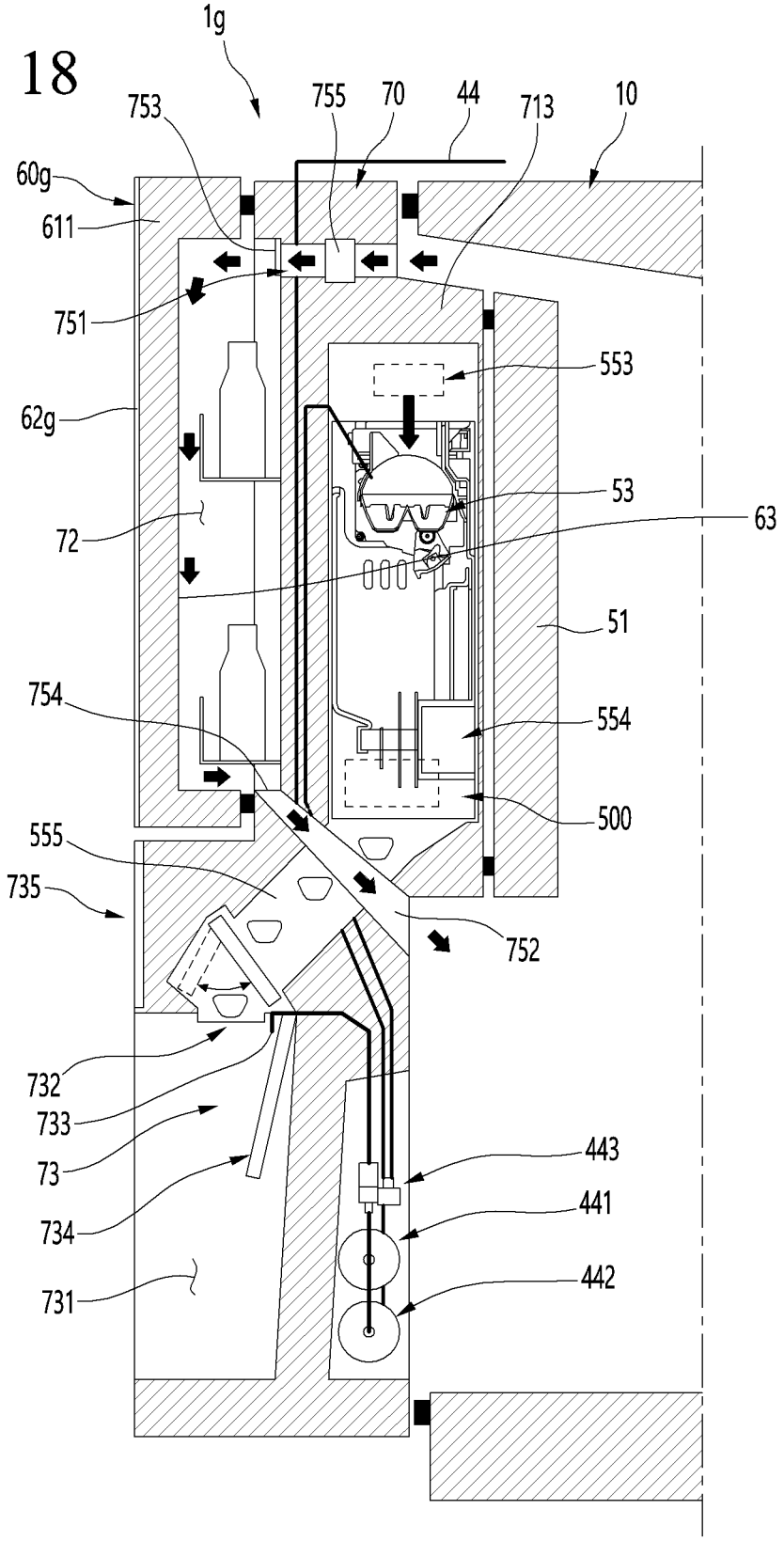
FIG. 18 is a cross-sectional view taken along line B-B of FIG. 11 according to a sixth embodiment.

FIG. 18 is a cross-sectional view taken along line B-B of FIG. 11 according to a sixth embodiment.

A refrigerator 1*g* according to a sixth embodiment may include a cabinet 10 in which a storage space 11 is defined, and a door that opens and closes the storage space 11.

The door may have a double door structure. The door may include a first door 70 that opens and closes the storage space 11, and a second door 60*g* that opens and closes the door storage portion 72 of the first door 470 at a front side. The storage space 11 may be a refrigerating compartment. The first door 70 may be the same as that of the foregoing fifth embodiment.

The first door 70 may have a door storage portion 72 in a front surface thereof and an ice-making chamber 50 in a rear surface thereof. An insulating material 713 may be provided inside the first door 70, and the front door storage portion 42 and the rear ice-making chamber 50 may be insulated from each other by the insulating material 713.

A cold air inlet 553 and a cold air outlet 554 may be provided in the ice-making chamber 50. The cold air inlet 553 may communicate with the ice-making chamber supply duct 551 inside the first door 70 and may supply cold air generated in the evaporator into the ice-making chamber 50. In addition, the cold air outlet 554 may communicate with the ice-making chamber return duct 552 inside the first door 70 to discharge the air in the ice-making chamber 50 again to the evaporator 14. Thus, the inside of the ice-making chamber 50 may be cooled to a temperature at which an ice-making operation of the ice maker 53 is performed.

The first door 70 may include a supply duct 751 and a discharge duct 752. The refrigerating compartment 11 and the door storage portion 72 may communicate with each other through the supply duct 751 and the discharge duct 752, and the door storage portion 72 may be cooled to a set temperature by the circulation of the cold air. Here, a temperature of the door storage portion 72 may be the same as that of the storage space 11.

The supply duct 751 may be disposed in an upper portion of the door storage portion 72, and the discharge duct 752 may be provided in a lower portion of the door storage portion 72. Thus, the cold air introduced into the supply duct 751 may flow downward from an upper side of the door storage portion 72 and then be discharged through the discharge duct 752 to uniformly cool the door storage portion 72. As an example, the inlet 753 that is in communication with the supply duct 751 may be opened to an upper end of the rear surface of the door storage portion 72, and the outlet 754 that is in communication with the discharge duct 752 may be opened to a lower end of the rear surface of the door storage portion 72.

The supply duct 751 or the discharge duct 752 may be provided with a storage portion fan 755 to smoothly supply and discharge the cold air to the door storage portion.

The dispenser 73 may be provided in the front surface of the first door 40*d*. The dispenser 73 may include a dispenser recess portion 731 that is recessed from the front surface of the first door 70. In addition, a water dispensing portion 732 and an ice dispensing portion 733 may be provided on a top surface of the dispenser recess portion 731 to dispense water or ice. In addition, a manipulation member 734 may be provided in the dispenser recess portion 731. The dispenser 73 may not be shielded by the second door 60 and may be configured to be always exposed.

The dispenser 73 may be provided at a lower portion of the first door 70. The dispenser 73 may be disposed below the door storage portion 72 and may be provided at a lower portion of the first door 70. A protrusion 714 further protruding forward than the door storage portion 72 may be disposed on the lower portion of the first door 70. In addition, the dispenser may be provided on a front surface of the protrusion 714 to define a portion of an outer appearance of the front surface of the refrigerating compartment door 21.

The supply duct 751 and the discharge duct 752 may communicate with the door storage portion 72 and may pass above and below the ice-making chamber 50 to communicate with the refrigerating compartment 11. That is, the supply duct 751 and the discharge duct 752 may be configured to extend by bypassing the ice-making chamber 50 without passing through the ice-making chamber 50.

The second door 60*g* may be provided in front of the first door 70 and may be rotatably mounted on the first door 70. The second door 60*g* may shield the door storage portion and may have the same plane as a lower portion of the first door 70 in a closed state. In addition, the second door 60*g* may be disposed above the dispenser 73. The door storage portion 42 may be opened and closed. The front outer appearance of the refrigerator 1*g* may be defined when the second door 60*g* is closed.

The front surface of the second door 60*g* may be defined by the door panel 62*g*. The door panel 62*g* may be made of various materials such as glass, metal, plastic, and a composite material. In addition, the insulating material 611 may be filled into the second door 60*g*. Thus, the door storage portion 72 may be thermally insulated by the insulating material 611. In addition, the cold air introduced into the door storage portion 72 may move along the rear surface 63 of the second door 60*g*.

Thus, the door storage portion 72 may be thermally insulated from the rear ice-making compartment 50 by the insulation material 713 of the first door 70 and may be thermally insulated from front external air by the insulation material 611 of the second door 60*g*. The cold air supplied into the door storage portion 72 may flow between the second door 60*g* and the first door 70. In addition, the inside of the door storage portion 72 may be maintained at a set temperature by the supplied cold air.

The following effects be expected in the refrigerator according to the proposed embodiments of the present invention.

The refrigerator according to the embodiments of the present invention may have the structure in which the ice-making chamber is provided in the rear surface of the first door, the door storage portion and the dispenser are provided in the front surface of the first door, and the door storage portion is shielded by the second door.

Therefore, there may be the advantage that the door storage space, the ice-making chamber, and the dispenser are efficiently disposed in one door, and the convenience of use is improved.

In addition, there may be the advantage that, when the second door is closed, the door storage portion and the dispenser are not exposed to the outside to more neatly improve the appearance while maintaining the convenience of use.

In addition, there may be the advantage that, even when the second door is closed, the door storage portion is selectively visualized through the see-through portion of the second door by the user's manipulation to more improve the convenience of use.

In addition, there may be the advantage that the cold air is supplied to each of the ice-making chamber and the door storage portion, in particular, the door storage portion is cooled using the cold air of the refrigerating compartment to efficiently supply the cold air.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that has a refrigerating compartment and a freezing compartment, each of the refrigerating compartment and the freezing compartment having a front opening; and a refrigerating compartment door configured to open and close at least a portion of the refrigerating compartment, wherein the refrigerating compartment door comprises:

a first door rotatably disposed at the cabinet, and a second door disposed at a front side of the first door and configured to rotate relative to the first door to thereby open and close at least a portion of the front side of the first door, wherein the first door comprises:

an ice-making chamber, an ice maker accommodated in the ice-making chamber, a door storage disposed forward relative to the ice-making chamber and configured to store food, the door storage being configured to be opened and closed by the second door, a dispenser disposed at a front surface of the first door, the dispenser being disposed below the door storage and configured to dispense ice from the ice-making chamber, a supply duct configured to communicate the refrigerating compartment with the door storage, the supply duct being configured to introduce cold air from the refrigerating compartment into the door storage, and a through-portion that passes through a lower portion of the first door and that is disposed below the dispenser, the through-portion being configured to discharge air from the door storage to the refrigerating compartment.

2. The refrigerator according to claim 1, wherein the ice-making chamber is recessed from a rear surface of the first door and defines a rear opening at the rear surface, wherein the door storage is recessed from the front surface of the first door, and wherein the first door further comprises an ice-making chamber door configured to open and close the rear opening of the ice-making chamber.

3. The refrigerator according to claim 1, wherein a rear surface of the second door is recessed and defines at least a portion of the door storage.

4. The refrigerator according to claim 1, wherein the door storage is disposed between the first door and the second door in a state in which the second door is closed.

5. The refrigerator according to claim 1, wherein the second door is configured to close the door storage and the dispenser simultaneously.

6. The refrigerator according to claim 5, wherein the second door comprises a panel assembly that overlaps with at least an area of each of the door storage and the dispenser, the panel assembly being configured to allow a rear side of the second door to be visible from an outside of the cabinet.

7. The refrigerator according to claim 6, further comprising a display disposed between the door storage and the dispenser, wherein the panel assembly is configured to allow the display to be visible therethrough from the outside of the cabinet.

8. The refrigerator according to claim 6, further comprising a door light disposed at the first door or the second door, the door light being configured to be turned on and off by manipulation of a user and to selectively illuminate the door storage.

9. The refrigerator according to claim 1, wherein the supply duct passes through the first door, the supply duct defining a passage that bypasses the ice-making chamber and that is configured to guide cold air from the refrigerating compartment to the door storage.

10. The refrigerator according to claim 9, wherein the first door further comprises a storage fan configured to cause the cold air to flow through the supply duct.

11. The refrigerator according to claim 1, wherein the first door further comprises:

an ice outlet defined at a top surface of the through-portion and configured to discharge ice from the ice-making chamber; and a manipulation member disposed at the top surface of the through-portion and configured to be manipulated for dispensing the ice through the ice outlet.

12. The refrigerator according to claim 1, wherein the first door further comprises a second door storage defined at the through-portion and configured to store food.

13. The refrigerator according to claim 12, wherein the second door is configured to open and close the through-portion, and wherein the second door comprises a panel assembly that is configured to allow the door storage and the second door storage to be visible from an outside of the cabinet.

14. The refrigerator according to claim 1, wherein the second door is configured to open and close the door storage that is disposed above the dispenser.

15. The refrigerator according to claim 14, wherein the first door further comprises a protrusion that is disposed at the lower portion of the first door and that protrudes forward relative to the door storage, and wherein the dispenser is disposed at the protrusion.

16. The refrigerator according to claim 1, wherein the second door comprises:

a door panel that defines a front surface of the refrigerating compartment door; and an insulation material that is provided inside the door panel and that extends from an upper end of the door panel and a lower end of the door panel.

17. A refrigerator comprising:

a cabinet that has a refrigerating compartment and a freezing compartment, each of the refrigerating compartment and the freezing compartment having a front opening; and a refrigerating compartment door configured to open and close at least a portion of the refrigerating compartment, wherein the refrigerating compartment door comprises:

a first door rotatably disposed at the cabinet, and a second door disposed at a front side of the first door and configured to rotate relative to the first door to thereby open and close at least a portion of the front side of the first door, wherein the first door comprises:

an ice-making chamber, an ice maker accommodated in the ice-making chamber, a door storage disposed forward relative to the ice-making chamber and configured to store food, the door storage being configured to be opened and closed by the second door, a dispenser disposed at a front surface of the first door, the dispenser being disposed below the door storage and configured to dispense ice from the ice-making chamber, a supply duct that passes through the first door from an upper side of the ice-making chamber and that fluidly communicates an upper portion of the door storage with the refrigerating compartment, the supply duct being configured to supply cold air from the refrigerating compartment to the door storage, and a discharge duct that passes through the first door from a lower side of the ice-making chamber and that fluidly communicates a lower portion of the door storage with the refrigerating compartment, the discharge duct being configured to discharge air from the door storage to the refrigerating compartment, and wherein the discharge duct extends through a portion of the first door between the lower side of the ice-making chamber and an upper side of the dispenser.

* * * * *